US006341548B1

(12) United States Patent
Hirahata et al.

(10) Patent No.: US 6,341,548 B1
(45) Date of Patent: Jan. 29, 2002

(54) DEVICE FOR ADJUSTING DISTANCE OF CUTTING BLADE FROM WORKPIECE SHEET

(75) Inventors: Shinichi Hirahata; Yasuhiro Ogawa; Tadanobu Chikamoto; Kazuyoshi Minaminaka, all of Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/292,941

(22) Filed: Apr. 16, 1999

(30) Foreign Application Priority Data

Apr. 17, 1998 (JP) ..... 10-107854
Mar. 19, 1999 (JP) ..... 11-075563

(51) Int. Cl.[7] ..... B26D 3/08

(52) U.S. Cl. ..... 83/881; 83/879; 83/699.41; 83/699.61

(58) Field of Search ..... 83/881, 879, 882, 83/875, 699.11, 698.61, 699.41, 699.61; 101/3.1, 28, 29, 124, 93.03, 4

(56) References Cited

U.S. PATENT DOCUMENTS

| | | | | | |
|---|---|---|---|---|---|
| 2,808,108 | A | * | 10/1957 | Pellegrino | 83/686 |
| 3,177,952 | A | * | 4/1965 | West | 101/3.1 |
| 3,802,516 | A | * | 4/1974 | Speicher | 101/3.1 |
| 4,141,264 | A | * | 2/1979 | Weisbeck | 83/140 |
| 4,608,891 | A | * | 9/1986 | Frisby et al. | 83/881 |
| 4,624,169 | A | * | 11/1986 | Nelson | 83/881 |
| 4,805,312 | A | * | 2/1989 | Datwyler | 83/881 |
| 4,854,205 | A | * | 8/1989 | Anderka | 83/881 |
| 4,920,495 | A | * | 4/1990 | Pilkington | 83/881 |
| 5,010,811 | A | * | 4/1991 | Almeras et al. | 101/3.1 |
| 5,038,654 | A | * | 8/1991 | Mackay | 83/881 |
| 5,694,838 | A | * | 12/1997 | Moll | 101/3.1 |
| 5,884,546 | A | * | 3/1999 | Johnson | 83/698.91 |
| 5,934,165 | A | * | 8/1999 | Chatham | 83/698.91 |
| 6,152,005 | A | * | 11/2000 | Ootsuka | 83/698.91 |

FOREIGN PATENT DOCUMENTS

| | | |
|---|---|---|
| DE | 195 21 604 C1 | 4/1997 |
| EP | 0 185 617 A | 11/1997 |
| GB | 2 313 081 A | 11/1997 |
| JP | Y2-2-14952 | 4/1990 |

* cited by examiner

*Primary Examiner*—M. Rachuba
*Assistant Examiner*—Kim Ngoc Tran
(74) *Attorney, Agent, or Firm*—Oliff & Berridge PLC

(57) ABSTRACT

A cutter shaft 40 provided with a cutter 43 as its lower tip is freely vertically movably disposed in a guide cylinder portion 17*a* of a cutter holder 17. A horizontal support body 47 is supported in a hollow case portion 17*b*. A large diameter first steel ball 45 and a small diameter second steel ball 46 are supported in the horizontal support body 47 separated by a suitable distance. The horizontal support body 47 supports the steel balls 45, 46 exposed from a lower end of the horizontal support body 47 but in a manner that prevents the steel balls 45, 46 from falling out of the horizontal support body 47. A cover body 48 is fixed on the upper surface of the horizontal support body 47 to prevent the first and second steel balls 45, 46 from moving in a vertical direction. The side edges of the horizontal support body 47 protrude from guide grooves 50*a*, 50*b* formed inside surfaces of the hollow case portion 17*b*. An adjustment screw screwingly engaged in a lid portion 17*c* presses downward on the cover body 48. On the other hand, resilient plate springs 54, 55 extending downward from the cover body 48 urge the cover body 48 upward.

19 Claims, 22 Drawing Sheets

DEVICE FOR ADJUSTING DISTANCE OF CUTTING BLADE FROM WORKPIECE SHEET

FIELD OF THE INVENTION

The present invention relates to a device for adjusting vertical position of a cutter, to enable half cut or full cut in label sheets, wallpaper sheets, strip coat sheets, and the like following an optional direction.

RELATED ART

Japanese Utility-Model Application Publication No. HEI-2-14952 discloses an example of a conventional device for adjusting vertical position of a cutter. The device has two electromagnetic solenoids for selectively adjusting the cutter between an uppermost position, wherein the workpiece is not cut at all, a half cut position, and a full cut position.

The device is provided with a head capable of movement in X and Y directions of a horizontal plane. An outer cylinder is rotatably disposed on the head. A shaft with a cutting blade at its lower end is mounted in a guide tube in the outer cylinder, capable of free vertical movement. A gear is fixed to the outer surface of the outer cylinder. The direction in which the cutting blade faces can be changed by rotating the outer cylinder via the gear.

Another cylinder is fixed to the upper end of the outer cylinder, and a disk is disposed on the other cylinder. A hole is formed in the disk, and the shaft protrudes through the hole. A reciprocal movement spring for urging the disk upwards is disposed between the other cylinder and the disk. A seesaw-type first lever is disposed with one end between the disk and a pin protruding horizontally above the disk from the shaft, and with the other end in confrontation with an output shaft of a half cut electromagnetic solenoid.

A stopper is disposed in a frame above the shaft in abutment with the upper end of the shaft. A cutter position adjustment screw is disposed above the stopper. A cutter pressure spring for urging the stopper downwards extends between the cutter pressure adjustment screw and the stopper. The stopper has a flange that abuts against with the frame to prevent the shaft from lowering beyond a full-cut position to be described later. A second lever is disposed with its operation end in confrontation with the flange of the stopper and with its center in confrontation with the operation shaft of a full cut electromagnetic solenoid.

The amount that the cutter pressure adjustment screw protrudes is adjusted to set force of the cutter pressure spring to a desired half cut amount. When the half cut electromagnetic solenoid is turned off, that is, when it is not energized, upwards urging force of the reciprocal movement spring raises the rising/lowering shaft upwards into a non-cut position via the disk, the tip of the first lever, and the pin.

Next, when the half cut electromagnetic solenoid is turned on, that is, when it is energized, the rising/lowering shaft is lowered to a half cut position by downwards urging force of the cutter pressure spring. When the full cut electromagnetic solenoid is turned on, the second lever presses the stopper downward, so the rising/lowering shaft can be set into its full cut position.

SUMMARY OF THE INVENTION

However, this configuration is extremely complicated and requires a great number of components including two expensive and large electromagnetic solenoids.

It is an objective of the present invention to provide a device for adjusting the vertical position of a cutter, using a simple configuration and horizontal movement of a cutter holder along a horizontal plane, to enable rising and lowering of the cutter in a plurality of different positions, such as a half cut or a full cut position, along a vertical path perpendicular to the horizontal plane.

To achieve the above-described objectives, a cutter according to the present invention includes a cutter holder, a cutter shaft, and a conversion unit. The cutter holder moves in opposing directions along a first path.

The cutter shaft moves within the cutter holder in opposing directions along a second path. The cutter shaft has two ends, one end being provided with a cutter that selectively protrudes from one end of the cutter holder depending on position of the cutter shaft along the second path with respect to the cutter holder.

The conversion unit is disposed at the other end of the cutter shaft, and converts movement of the cutter holder along the first path into movement of the cutter shaft along the second path, to select position of the cutter shaft on the second path with respect to the cutter holder.

Because the conversion unit converts movement of the cutter holder in the one direction into movement of the cutter shaft in another direction, there is no need to provide a separate actuator, such as a solenoid, only for the purpose of selecting position of the cutter shaft. Fewer parts components are necessary and the overall configuration can be simplified.

It is desirable that the conversion unit include an operation member and a selection unit configured in the following manner. The operation member is partially disposed in the cutter holder. The operation member has two ends that protrude away from each other from opposite sides of the cutter holder in the opposing directions of the first path. The operation member moves in a selected one of the opposing directions of the first path by abutment of one of the ends caused by movement of the cutter holder in the other of the opposing directions of the first path.

The selection unit is disposed in contact with the other end of the cutter shaft, and is driven to select position of the cutter shaft along the second path by movement of the operation member in the selected one of the opposing directions of the first path.

With this configuration, the operation member can be linearly moved by moving the cutter holder in parallel with the opposing directions in which the ends of the operation member extend. The linear movement of the operation member drives the selection unit to select the position of the cutter shaft. Therefore, the position of the cutter shaft, and consequently whether cutting is performed, or if so, the depth of cuts, can be easily adjusted, selected, or both, by merely controlling the amount and direction of cutter holder movement.

It is alternatively desirable that the conversion unit include a selection member and an operation member configured in the following manner. The selection member has a screw portion and moves in one of the opposing directions of the second path by screwing action generated when the selection member rotates in one direction, and in another of the opposing directions of the second path by screwing action generated when the selection member rotates in an opposite direction.

The operation member has one end connected to the selection member and another end protruding through a side of the cutter holder. The operation member rotates the selection member in a corresponding direction when pivoted, the operation member pivoting according to abutment of the other end caused by movement of the cutter holder.

With this configuration, the operation member is pivoted by movement of the cutter holder along the first path, which can be horizontally aligned, for example. Pivoting movement of the operation member rotates the selection member, which screwingly rises upward in parallel with an imaginary axial line of the cutter shaft, to a degree corresponding to the amount the selection member rotates. The position of the cutter shaft along the second path, which can be vertically aligned, for example, can be adjusted or selected corresponding to the amount that the selection member is screwed up. Therefore, by only controlling the movement amount of the cutter holder, the cutting depth of the cutter can be easily selected or adjusted.

It is also desirable to provide an adjustment unit that adjusts an initial position of at least one of the operation member and the selection unit along the second path. With this configuration, the depth of half cuts or full cuts can be easily preadjusted corresponding to the thickness of the workpiece to be cut.

It is alternatively desirable to that the conversion unit include a presser, a movement unit, and a selection unit configured in the following manner. The presser is disposed at the other end of the cutter shaft and freely movable in the opposing directions of the second path.

The movement unit is connected to the presser and protrudes from the other end of the cutter holder. The movement unit moves the presser selectively in the opposing directions of the second path, depending on rotational direction of the movement unit.

The selection unit rotates the movement unit in a rotational direction that depends on direction of movement of the cutter holder, in order to move the presser, and consequently the cutter shaft, in a corresponding one of the opposing directions of the second path.

With to this configuration, when the cutter holder moves along the first path, the selection unit rotates the movement unit in a rotational direction that depends on direction of movement of the cutter holder, in order to move the presser, and consequently the cutter shaft, in a corresponding one of the opposing directions of the second path. Rotation of the movement means moves the presser in a corresponding direction, so that the amount that the blade tip at the end of the cutter shaft protrudes can be adjusted.

It is desirable that these operations be performed when the cutter holder is disposed in a position that prevents the blade tip from contacting a workpiece in confrontation with the other end of the cutter holder. After the position of the cutter shaft has been adjusted or selected, the cutter holder need only by lowered to perform cutting operations.

In this way, the operations for adjusting a protrusion amount of the blade tip and cutting operations can be distinguished from each other by selecting vertical position of the cutter holder. Furthermore, the protrusion amount of the blade tip can be greatly or slightly adjusted selectively by selecting movement direction of the cutter holder along the first path while the cutter holder is in its raised up position. Accordingly, an operation for adjusting a protrusion amount of the blade tip can be executed by using movement of the cutter holder while the cutter holder is in its raised position to interrupt cutting operations. As a result, there is no need to provide a separate actuator for this purpose. Also, adjustment operations can be easily performed.

It is alternatively desirable that the movement unit include a lid, a screw shaft portion, and a gear, and that the selection unit includes a pair of planetary gears, all having the following configuration. The lid is disposed at the other end of the cutter holder.

The screw shaft portion is screwingly engaged in the lid and is interlockingly connected with the presser to move integrally with the presser along the second path. The gear protrudes from the other end of the cutter holder and rotates integrally with the screw shaft portion.

The pair of planetary gears alternately engage with the gear of the movement unit, depending on movement direction of the cutter holder. That is, one planetary gear rotates the gear of the movement unit in one direction, and the other planetary gear rotates the gear of the movement unit in another direction.

With this configuration, rotational direction of the gear and the screw shaft portion can be accurately switched using the planetary gears. Also, amount that the presser and the screw shaft portion are moved in the opposing directions of the second path can be accurately changed by the amount that the planetary gears rotate the gear. Also, because the movement amount is stable, the amount that the blade protrudes can be accurately set.

It is desirable that the pair of planetary gears be disposed at different positions from each other in the opposing directions of the second path, and rotate the gear of the movement unit in a suitable direction to adjust position of the presser in the cutter holder with respect to the opposing directions of the second path.

With this configuration, rotational direction of the gear can be selected without error so that the position of the presser in the cutter holder can be accurately adjusted.

It is alternatively desirable that the movement unit includes a lid, a shaft portion, and a gear, and that the selection unit includes a pair of planetary gears, all configured in the following manner. It should be noted that in this case the presser is non-rotatably disposed in the cutter holder.

The lid is disposed at the other end of the cutter holder. A shaft portion is freely rotatably supported in the lid in a manner that prevents movement of the shaft portion in the opposing directions of the second path with respect to the lid. The shaft portion is screwingly engaged with the presser. The gear rotates integrally with the shaft portion.

The pair of planetary gears alternately engage with the gear of the movement unit, depending on movement direction of the cutter holder. That is, one planetary gear rotating the gear of the movement unit in one direction, and the other planetary gear rotates the gear of the movement unit in another direction.

With this configuration, when the cutter holder moves along the first path, the selection unit rotates the movement unit in a rotational direction that depends on direction of movement of the cutter holder, in order to move the presser, and consequently the cutter shaft, in a corresponding one of the opposing directions of the second path. Rotation of the movement means moves the presser in a corresponding direction, so that the amount that the blade tip at the end of the cutter shaft protrudes can be adjusted.

It is desirable that these operations be performed when the cutter holder is disposed in a position that prevents the blade tip from contacting a workpiece in confrontation with the other end of the cutter holder. After the position of the cutter shaft has been adjusted or selected, the cutter holder needs only be lowered to perform cutting operations.

In this way, the operations for adjusting a protrusion amount of the blade tip and cutting operations can be distinguished from each other by selecting vertical position of the cutter holder. Furthermore, the protrusion amount of the blade tip can be greatly or slightly adjusted selectively by selecting movement direction of the cutter holder along the first path while the cutter holder is in its raised up position. Accordingly, an operation for adjusting a protrusion amount of the blade tip can be executed by using movement of the cutter holder while the cutter holder is in its raised position to interrupt cutting operations. As a result, there is no need to provide a separate actuator for this purpose. Also, adjustment operations can be easily performed.

BRIEF DESCRIPTION OF THE DRAWINGS

The above and other objects, features and advantages of the invention will become more apparent from reading the following description of the preferred embodiment taken in connection with the accompanying drawings in which:

FIG. 18(*b*) is a cross-sectional view showing the cutter holder of FIG. 17 with the cutter in a protruding position;

FIG. 19(*b*) is a side view showing a second lever of the mechanism of FIG. 19(*a*);

FIG. 21(*b*) is a side view showing the mechanism of FIG. 21(*a*), with the cam plate oriented in a phase of 9°;

FIG. 21(*c*) is a side view showing the mechanism of FIG. 21(*a*), with the cam plate oriented in a release position phase of 141°;

FIG. 22(*b*) is a side view showing the mechanism of FIG. 21(*a*), with the cam plate oriented in a cutting phase of 300°;

FIG. 24(*b*) is a plan view showing orientation of the selection mechanism when the cutter is being raised;

FIG. 24(*c*) is a plan view showing orientation of the selection operation means when the cutter is being lowered;

FIG. 25(*b*) is a cross-sectional view showing the cutter in a half cut condition slightly piercing the tack sheet;

FIG. 25(*c*) is a cross-sectional view showing the cutter in a full cut condition completely piercing the tack sheet.

DETAILED DESCRIPTION OF THE EMBODIMENTS

Figure 1:
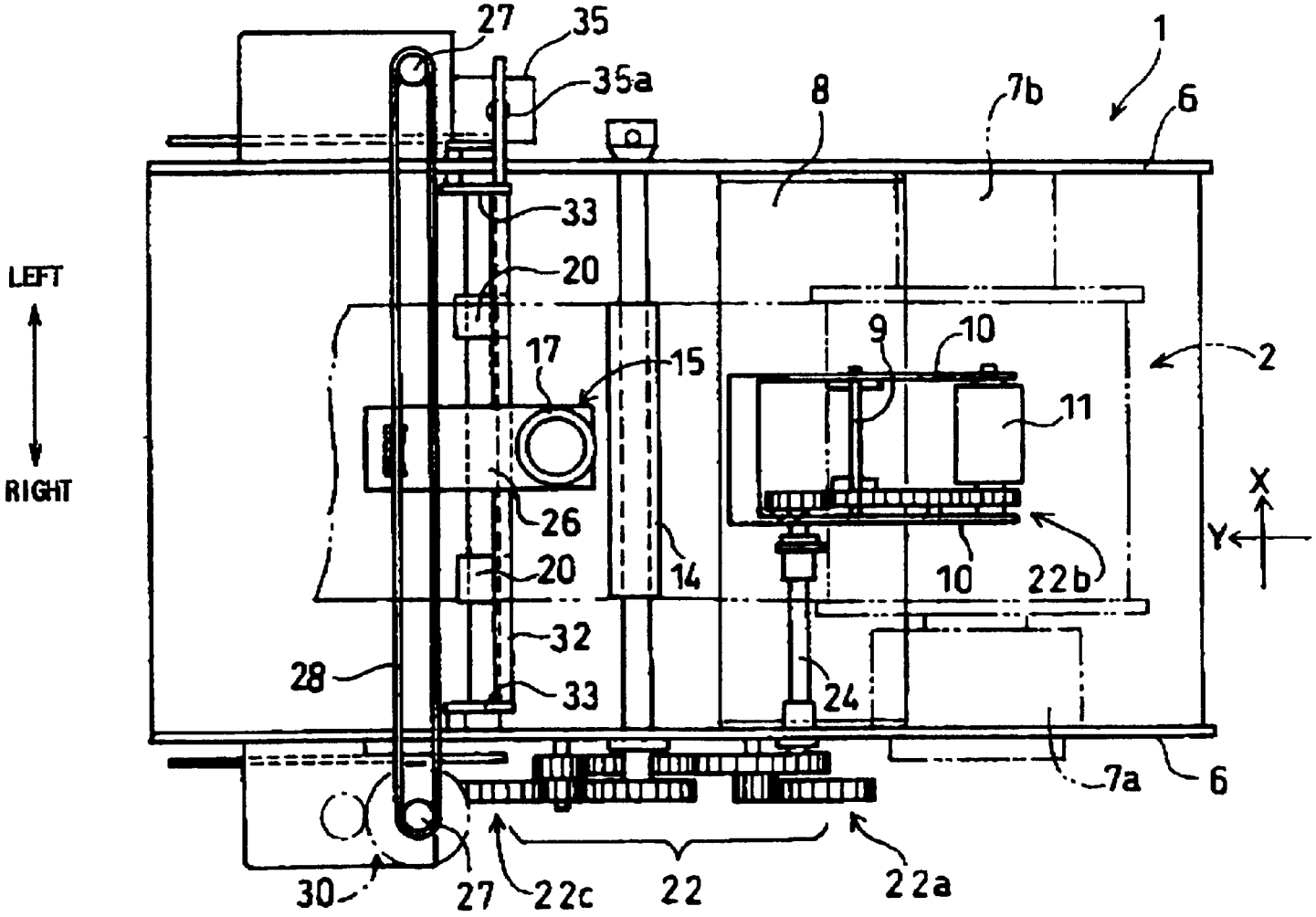
FIG. 1 is a plan view showing a tack sheet printing device including a cutting portion according to a first embodiment of the present invention.
Figure 2:
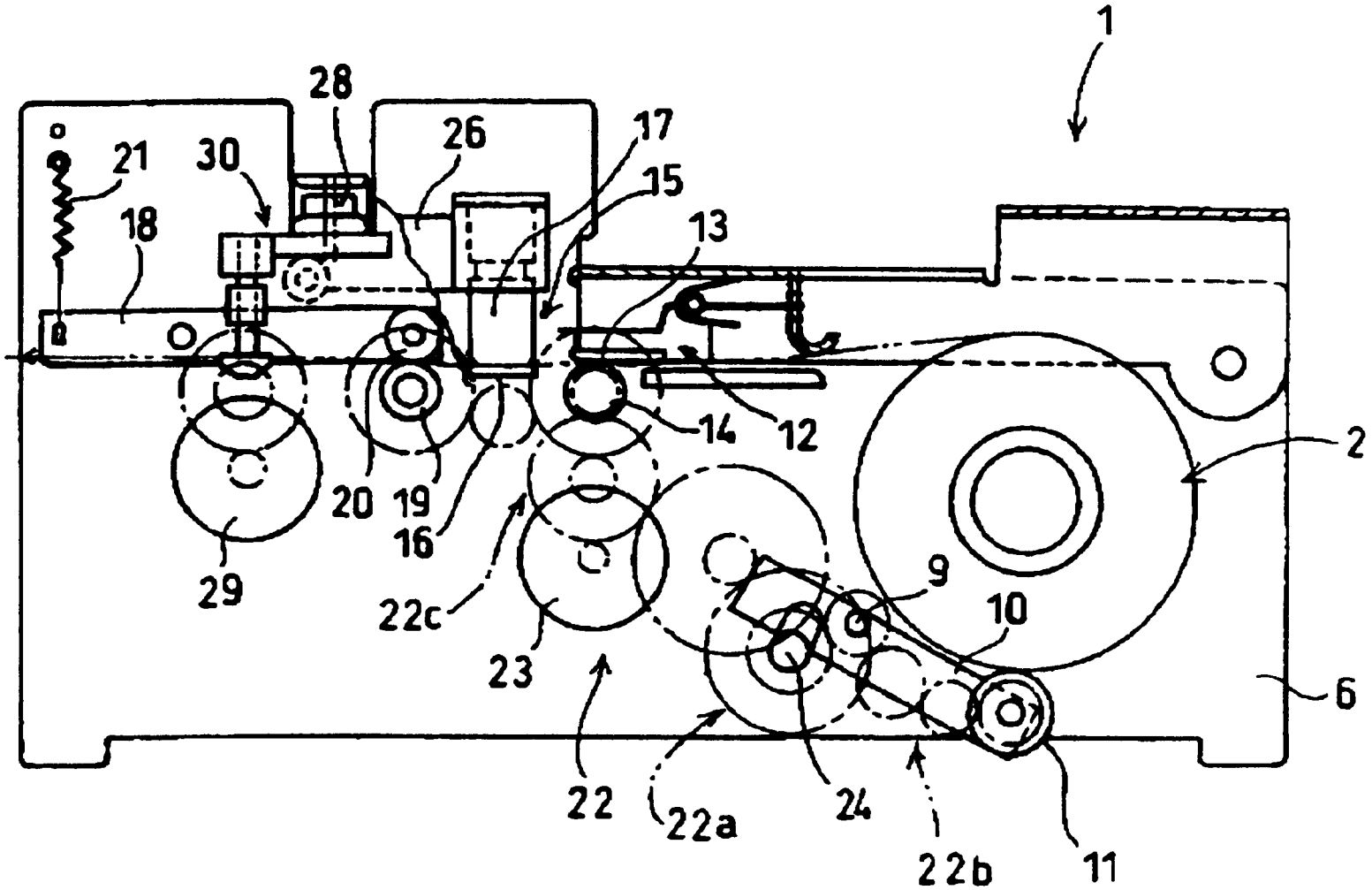
FIG. 2 is a cross-sectional side view of the printing device of FIG. 1.
Figure 3:
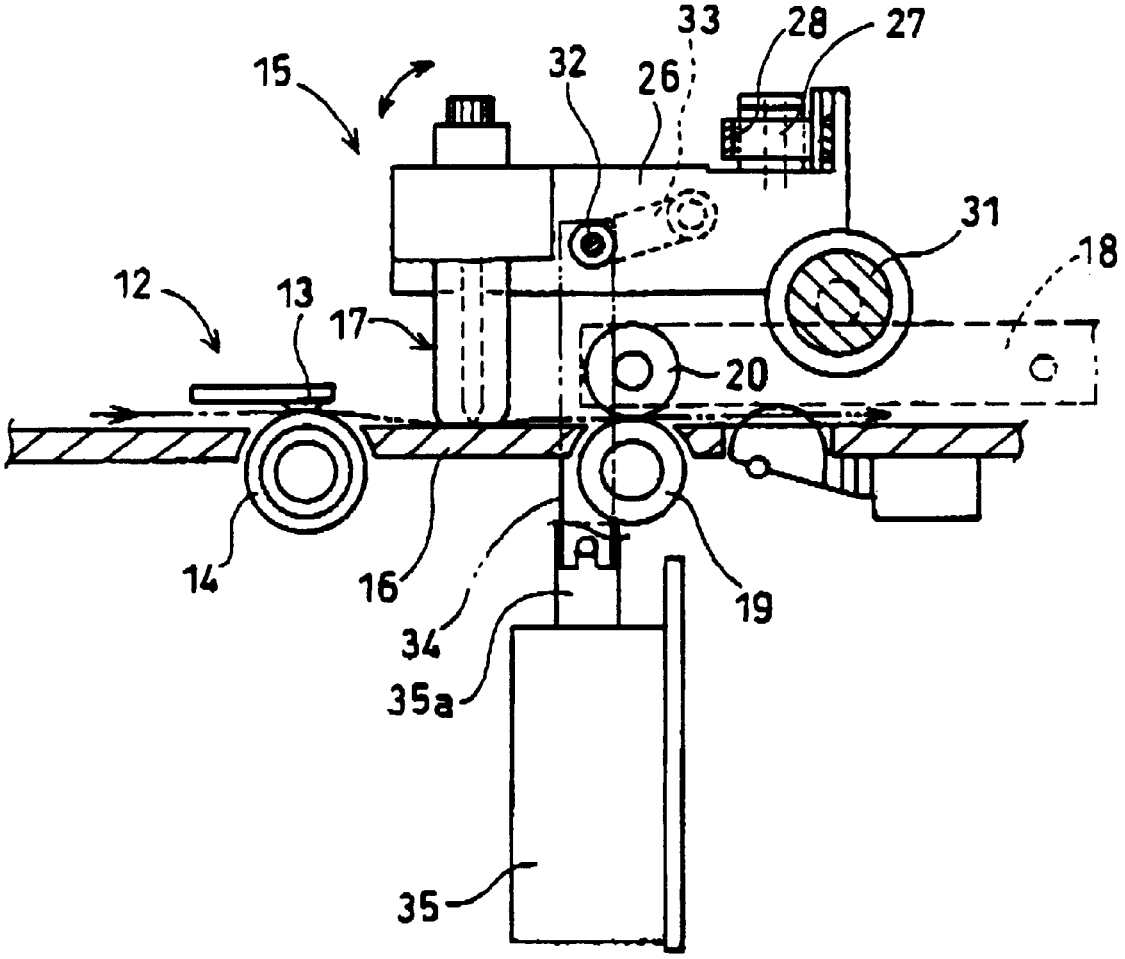
FIG. 3 is an enlarged cross-sectional view showing mechanism for raising and lowering a cutter holder of the cutting portion.
Figure 4:
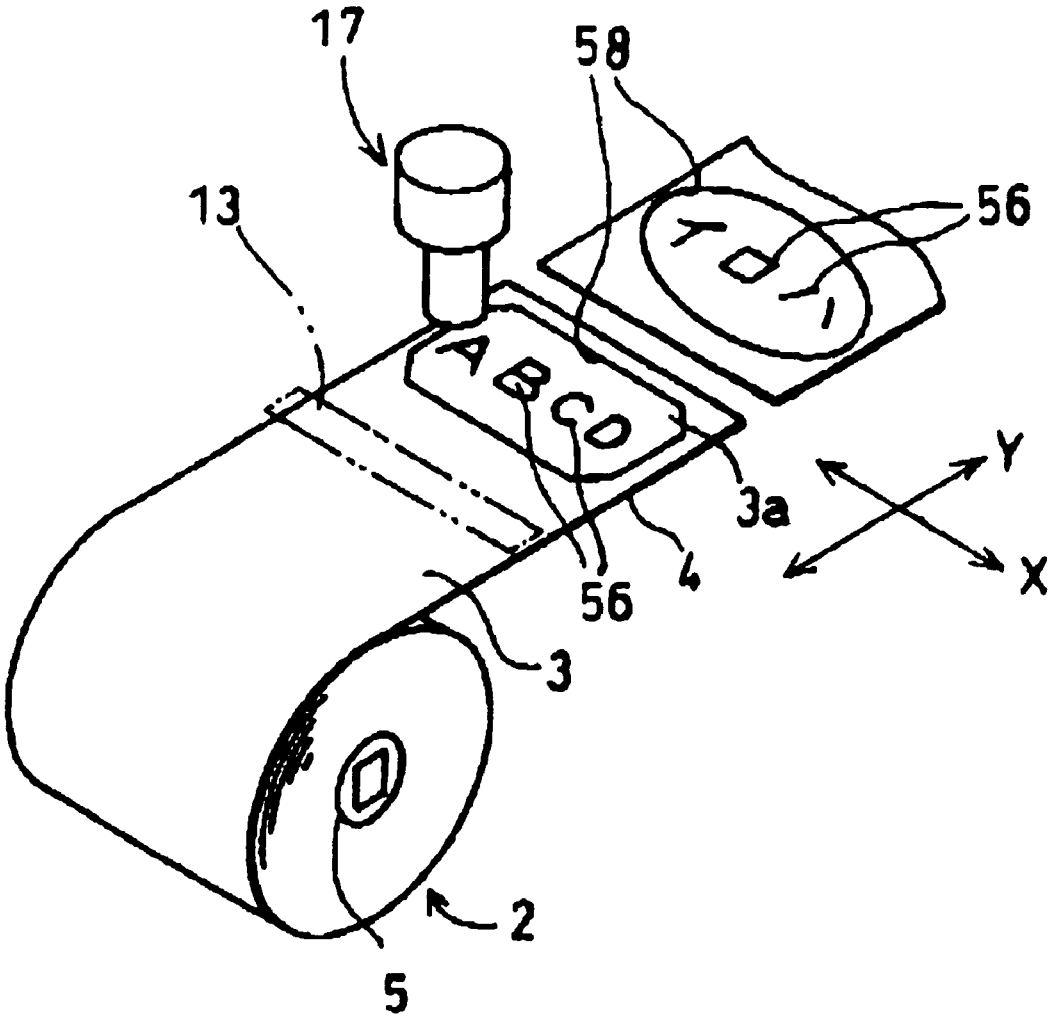
FIG. 4 is a perspective view showing a roll sheet of tack paper used in the printing device.
Figure 5:
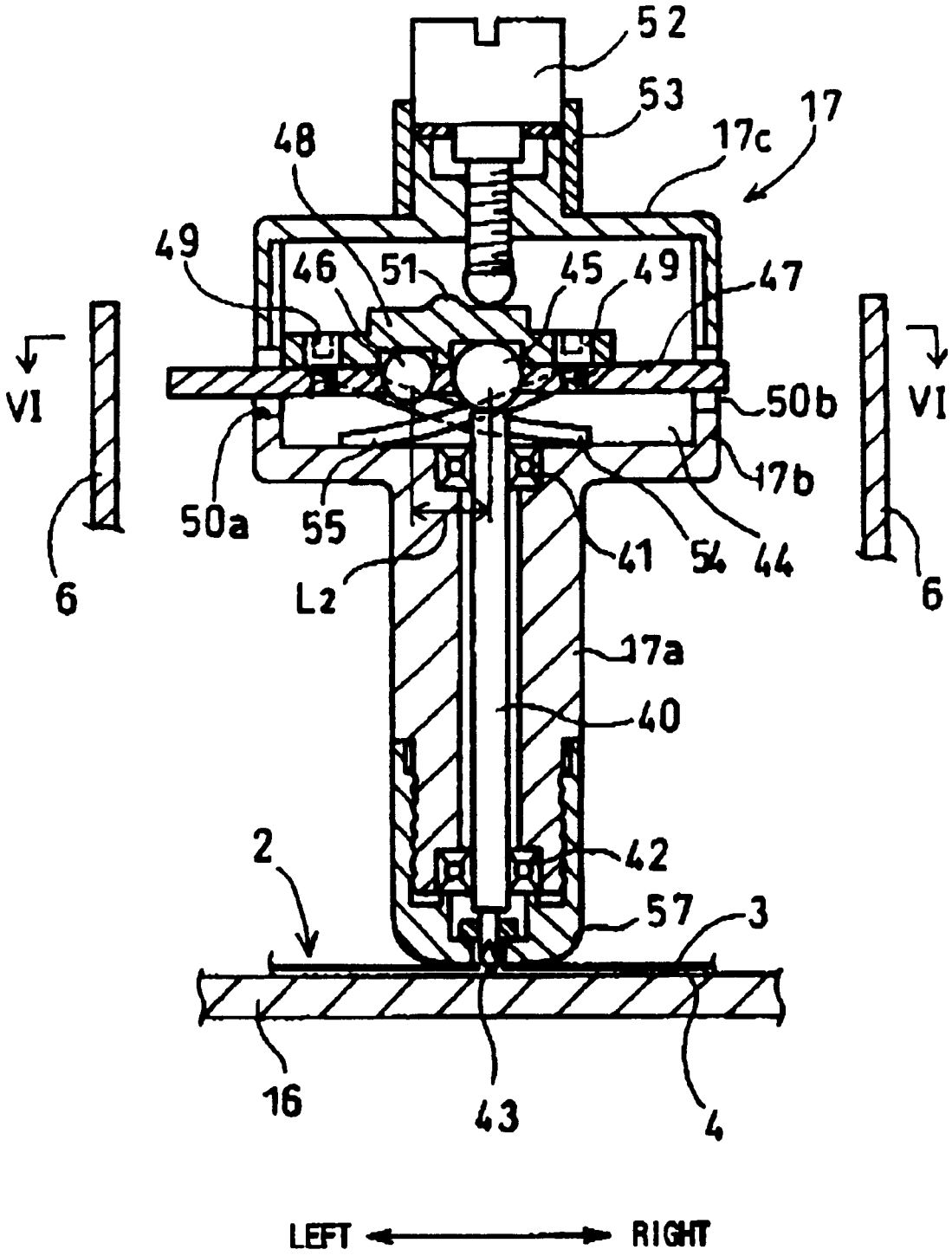
FIG. 5 is a cross-sectional side view showing the cutter holder.

Embodiments of the present invention will be described while referring to the accompanying drawings, wherein like parts and components are designated by the same reference numerals to avoid duplicating description FIG. 1 is a plan view showing a tack sheet printing device 1 including a cutting portion 15 according to a first embodiment of the present invention. FIG. 2 is a cross-sectional view of the printing device 1. FIG. 3 is a side view showing a mechanism for raising and lower a cutter holder of the cutter portion. FIG. 4 is a perspective view showing a roll sheet 2 of tack paper. FIG. 5 is a cross-sectional view of the cutter holder.

As shown in FIG. 4, the roll sheet 2 is used by the tack sheet printing device 1 as a workpiece to be cut. The recording sheet 3 is produced by coating an adhesive, such as a pressure sensitive adhesive, on the rear surface of a recording sheet, which is a band-shaped sheet of paper that can be printed on its surface. A band-shaped separation sheet 4 is then adhered onto the adhesive layer. Normally the roll sheet 2 is wound on a paper tube 5. The recording sheet 3 can also be formed from a gloss-coated paper or a synthetic resin film.

As shown in FIGS. 1 and 2, the tack sheet printing device 1 includes right and left side chassis frames 6, 6. A pair of support shafts 7*a*, 7*b* are disposed, one on each of the chassis frames 6, 6. The support shafts 7*a*, 7*b* are configured to freely, rotatably support the paper tube 5 of the roll sheet 2 and enable replacement of the roll sheet 2, including the paper tube 5. A connection frame 8 connects the chassis frames 6, 6 with each other. A pair of swing arms 10, 10 are supported on the connection frame 8 via a lateral shaft 9. A feed roller 11 is freely, rotatably supported between tips of the swing arms 10, 10. The feed roller 11 is driven to rotate by a gear transmission mechanism 22 to be described later. The feed roller 11 abuts against the outer peripheral surface of the roll sheet 2 and transports the roll sheet 2 towards a print portion 12, which includes a print head 13 and a platen roller 14. The feed roller 11 is configured to enable reverse feed of the roll sheet 2 in order to perform a half cut operation to be described later.

According to the present embodiment, the print head 13 is a line thermal head with a width substantially the same as the width of the roll sheet 2. A thermally sensitive sheet is used as the recording sheet 3. However, other types of print heads, such as an ink jet print head, a type of head that prints using an ink ribbon and dot pins, or a thermal head, can be used as the print head 13 instead.

The cutting portion 15 is disposed downstream from the print portion 12 in the transport direction of the roll sheet 2. The cutting portion 15 includes a cutting bed 16 at its lower surface and a cutter holder 17 above the cutting bed 16. The cutting holder 17 is capable of reciprocal movement in the widthwise direction of the roll sheet 2. A transport pinch roller portion is disposed adjacent the cutting portion 15 at a position downstream from the cutting bed 16. The transport pinch roller portion includes a drive roller 19 and pressing roller 20. The pressing roller 20 is supported on an end of a swing lever 18, which is urged to pivot downwards by an urging spring 21.

A first drive motor 23 is attached to the inner surface of one of the chassis frames 6. In the present embodiment, the first drive motor 23 is attached to the right-hand chassis frame 6. The first drive motor 23 is, for example, a step motor capable of forward and reverse rotation. The first drive motor 23 drives the feed roller 11 via a first gear transmission portion 22*a,* a transmission shaft 24, and a second gear transmission portion 22*b.* The first gear transmission portion 22*a* is formed from a plurality of gears disposed on the outer surface of the right-hand chassis frame 6. The second gear transmission portion 22*b* is disposed on one of the swing arms 10. The first drive motor 23 also drives the platen roller 14 and the drive roller 19 to rotate in the same direction via a third gear transmission portion 22*c.*

It should be noted that when the first drive motor 23 rotates in a forward direction, that is, the counter clockwise direction as viewed in FIG. 2, the feed roller 11 rotates in a clockwise direction and the platen roller 14 and the drive roller 19 rotate in the counterclockwise direction. As a result, the roll sheet 2 is rotated in the counterclockwise direction and the sheet is transported in a feed direction. On the other hand, when the first drive motor 23 rotates in the reverse rotational direction, that is, the clockwise direction as viewed in FIG. 2, the feed roller 11 rotates in the counterclockwise direction and the platen roller 14 and the drive roller 19 rotate in the clockwise direction so that the roll sheet 2 is rotated in the clockwise direction and the sheet is rolled back up onto the roll sheet 2.

In order to enable reciprocal movement of the cutter holder 17 across the width of the roll sheet 2, that is, in a direction perpendicular to the transport direction of the roll sheet 2, a carriage 26, on which the cutter holder 17 is fixed, is connected to one portion of a timing belt 28. The timing belt 28 is wound between a pair of pulleys 27, 27, which are each mounted on one of the chassis frames 6, 6. A second drive motor 29 is fixed to an outer surface of the right side frame 6. The second drive motor 29 is, for example, a step motor capable of forward and reverse rotation. Driving force from the second drive motor 29 is transmitted to drive the pulleys 27, 27 via a fourth gear transmission portion 29 formed from a plurality of flat gears and beveled gears.

As shown in FIGS. 1 and 3, the base of the carriage 26 is freely slidably fitted on a main guide shaft 31. An auxiliary guide shaft 32 freely, slidably penetrates through the center of the carriage 26. Pivot arms 33, 33 are provided on the chassis frames 6, 6 and attached one to either end of the auxiliary guide shaft 32. One end of the auxiliary guide shaft 32 is connected to an output shaft 35*a* of a first electromagnetic solenoid 35 via an operation link 34. The first electromagnetic solenoid 35 is provided to the outer surface of the left-hand chassis frame 6. The lower tip of the cutter holder 17, from which a cutter blade protrudes, is urged to press against the upper surface of the cutting portion bed 16 by an urging spring not shown in the drawings. When the first electromagnetic solenoid 35 is turned on, the output shaft 35*a* protrudes upwards as viewed in FIG. 3. This movement is transmitted to the carriage 26 via the operation link 34, the pivot arm 33, and the auxiliary guide shaft 32 so as to pivot the carriage 26 upwards. As a result, the lower tip of the cutter holder 17 is separated away from the upper surface of the roll sheet 2.

The swing arm 18 is swung in the vertical direction by a second electromagnetic solenoid not shown in drawings.

Next, an explanation will be provided for a mechanism for adjusting a rising and lowering amount of the cutter.

Figure 6:
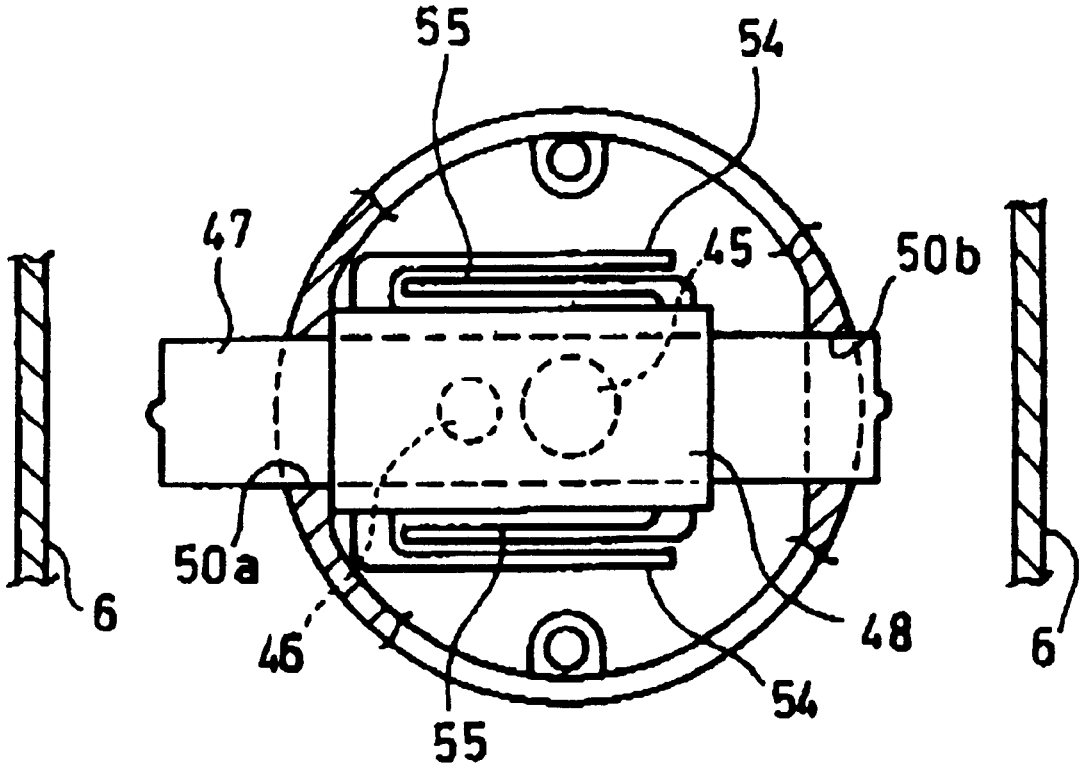
FIG. 6 is a cross-sectional view taken along line VI—VI of FIG. 5.

The cutter holder 17 is shown in detail in FIGS. 5 and 6. A circular-rod shaped cutter shaft 40 is fitted within a guide cylinder portion 17*a* at the lower portion of the cutter holder 17. A pair of upper and lower bearings 41, 42 enable the cutter shaft 40 to rotate around its lengthwise axis and move in the vertical direction.

Figure 11:
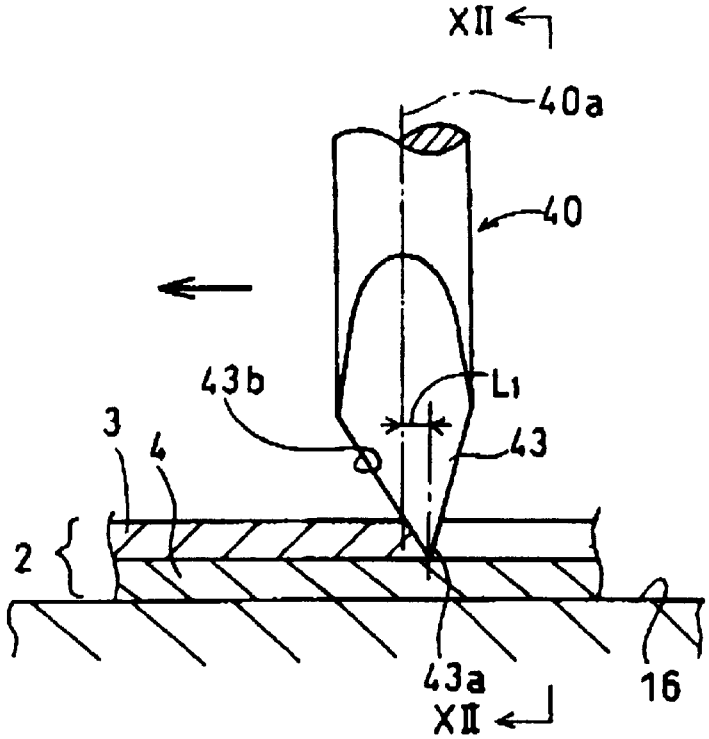
FIG. 11 is a magnified view showing essential portions of a cutter disposed in a half cut position in the cutter holder.

As shown in FIG. 11, a cutter blade 43 is integrally provided to the lower tip of the cutter shaft 40. According to the embodiment, a blade tip 43*a* of the cutter 43 is shifted by a distance L1 from an imaginary axial line 40*a* of the cutter shaft 40 downstream with respect to the direction (indicated by an arrow in FIG. 11) of forward movement of the cutter shaft 40. The cutter 43 is pressed against a work piece by placing a load at the axial center at the upper edge surface of the cutter shaft 40. This displacement of the cutter blade 43*b* from the imaginary axial line 40*a* enables the cutter blade 43*b* of the cutter 43 to be continually directed in the direction of the forward movement, even when forward movement of the cutter shaft 40 across the roll sheet 2 is changed leftward or rightward. It should be noted that the cutter blade 43*b* can be detachable (replaceable) with respect to the cutter shaft 40.

As shown in FIGS. 5 and 6, a chamber 44 is defined by a hollow case 17*b,* which is connected above the guide cylinder portion 17*a,* and a lid portion 17*c* covering the hollow case portion 17*b.* The upper end (horizontal end surface) of the cutter shaft 40 is exposed into the chamber 44. Configuration for selecting lowering amount of the cutter shaft 40 is disposed in the chamber 44. That is, a large diameter first steel ball 45 and a small diameter second steel ball 46 are supported in support indentations of a horizontal support body 47, separated by an appropriate distance L2 and supported in a manner where they can not fall out of the support indentations. A cover body 48 is fixed to the upper surface of the horizontal support body 47 by a screw 49 to prevent the first and second steel balls 45, 46 from moving vertically.

The horizontal support body 47 is formed in a substantially rectangular plate shape. Guide grooves 50*a,* 50*b* are cut in confronting side walls of the hollow case portion 17*b.*

The ends of the horizontal support body 47 protrude from the guide grooves 50*a,* 50*b* out of the cutter holder 17. A curved protrusion 51 is formed on the upper surface of the cover body 48 and an adjustment screw 52 is screwingly engaged in the lid portion 17*c*. The adjustment screw 52 is for adjusting a vertical position, that is, the height, of the horizontal support body 47, and consequently of the first and second steel balls 45, 46. A hemispherical lower portion of the adjustment screw 52 abuts against the upper surface of the cover body 48. A stopper screw ring 53 is disposed on the upper surface of the lid portion 17*c* to prevent the adjustment screw 52 from being accidentally rotated.

Two pairs of resilient plate springs 54, 54, 55, 55 extend in an arc shape downward from left and right sides of the cover body 48. The plate springs 54, 54, 55, 55 are slidably pressed down on the bottom surface of the hollow case portion 17*b*. It should be noted that a slide cover 57 is screwed onto the lower tip of the guide cylinder portion 17*a*. The slide cover 57 slides across the surface of the roll sheet 2, which is a workpiece to be cut.

Next, an explanation will be provided for operations of the tack sheet printing device 1. The roll sheet 2 is set at a predetermined position in the printing device 1. The front edge of the roll sheet 2 is positioned adjacent to the print portion 12. Then, a power source, not shown in the drawings, is turned on. Image data, such as for characters and symbols, is prepared in an external device, such as a personal computer, or the printing device 1 itself. The image data is transmitted to a memory portion in a controller of the printing device 1.

Next, once a start command is received, the first drive motor 23 rotates in the forward direction so that the feed roller 11 rotates and the roll sheet 2 progresses forward between the platen roller 14 and print head 13. As this is occurring, the image data is developed into character data, for example, and sent to the print head 13, which is a thermal head. Predetermined thermal elements of the print head 13 are driven to print characters 56 and the like on the thermally sensitive recording sheet 3 as shown in FIG. 4. When the front edge of the roll sheet 2 reaches the location of the pinch roller in the cutting portion 15, the roll sheet 2 is sandwiched between the drive roller 19 and the pressing roller 20, and transported leftward as viewed in FIG. 2.

When the roll sheet 2 is to be cut across its width as shown in FIG. 4 in order to cut away the front end with respect to the transport direction, the first electromagnetic solenoid 35 is turned off so that the slide cover 57 of the cutter holder 17 abuts against the surface of the recording sheet 3. While the slide cover 57 is pressed downward by an urging spring not shown in the drawings, as will be described later the cutter 43 is lowered into a full cut position so that both the recording sheet 3 and the separation sheet 4 are cut at the same time. When only the recording sheet 3 is to be cut to form a tack sheet 3*a* shown in FIG. 4 formed with predetermined rectangular or ellipsoidal shapes, for example, the cutter 43 is lowered into its' half cut position and the cutter holder 17 and the roll sheet 2 are moved relative to each holder 17 in X and Y directions.

Accordingly, when the roll sheet 2 is to be half cut or full cut in a direction parallel with the transport direction, first, the second drive motor 29 is operated to move the carriage 26 in the X direction (leftward and rightward directions) shown in FIG. 4 to position the blade tip 43*a* of the cutter 43 at a predetermined position. Next, the first drive motor 23 is rotated in the forward direction or the reverse direction to transport the roll sheet 2 in the Y direction (forward and rearward directions). When the roll sheet 2 is to be half cut as indicated by a line 58, in a slant or curve shape with respect to the transport direction, or full cut, both the first drive motor 23 and the second drive motor 29 are operated simultaneously. To cut the roll sheet 2 in a direction perpendicular to the transport direction, the first drive motor 23 is stopped and only the second drive motor 29 is operated to move the carriage 26 in the X direction (leftward and rightward) shown in FIG. 4.

Figure 12:
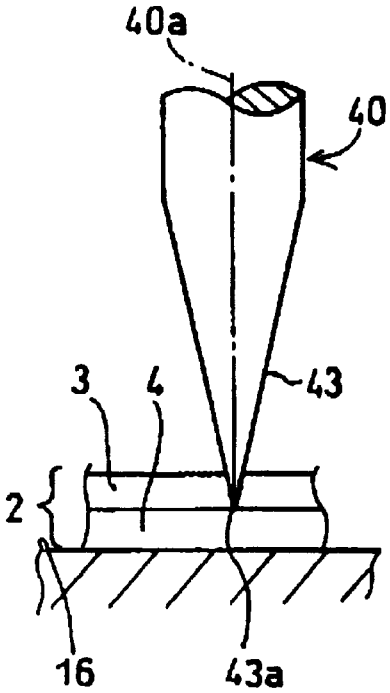
FIG. 12 is a side view taken along a line XII—XII of FIG. 11.
Figure 13:
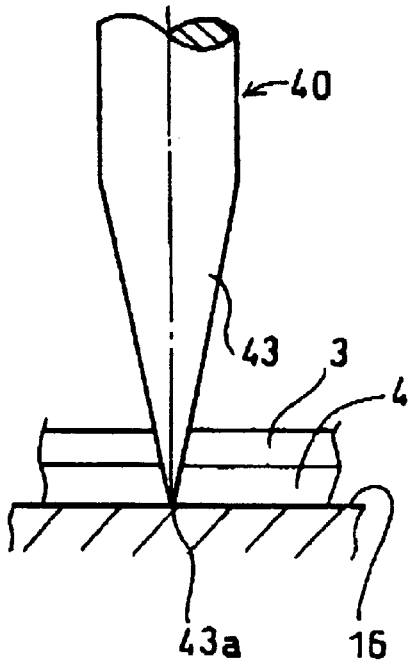
FIG. 13 is a magnified side view showing essential portions of the cutter disposed in a full cut position in the cutter holder.

Next, an explanation will be provided for operations to adjust the height of the cutter 43 in order to perform a half cut or a full cut by movement of the cutter holder 17. For example, at first as shown in FIG. 5, the horizontal support body 47 is set at a position where its left edge greatly protrudes out of the case position 17*b,* so that the large diameter first steel ball 45 presses down on the upper end of the cutter shaft 40. In this condition, the cutter shaft 40 is in its full cut position. As shown in FIG. 13, the cutter blade 43*b* of the cutter 43 is greatly lowered to reach the upper surface of the bed 16. In this condition, both the separation sheet 4 and the recording sheet 3 can be cut at the same time. While in this condition, the second drive motor 29 is driven in the forward direction to move the cutter holder 17, via the timing belt 28, leftward as viewed in FIGS. 5 and 6 until the left tip of the horizontal support body 47 abuts against the left chassis frame 6, whereupon the horizontal support body 47 moves rightwards with respect to the cutter holder 17. When the horizontal support body 47 moves rightwards, the large-diameter first steel ball 45 is separated from the upper edge of the cutter shaft 40, and in its place, the small-diameter second steel ball 46 presses down on the upper end of the cutter shaft 40. As a result, the cutter shaft 43 rises upward by a distance equal to the difference in the radius of the first steel ball and the radius of the second steel ball 46. In this way, the half cut position shown in FIGS. 11 and 12 can be selected.

Although the support body 47 and the cover body 48 are urged upward by the resilient plate springs 54, 55, the adjustment screw 52 pressing against the upper surface of the cover body 48 regulates the maximum height at which the cutter shaft 43 can be raised upward. As a result of this configuration, there will be no unevenness in depth of full cuts and half cuts.

When the cutter shaft 40 is moved from the half cut position to the full cut position, the cutter holder 17 is moved rightward as viewed in FIG. 5 so that the right end of the horizontal support body 47 abuts against the right chassis frame 6. The horizontal support body 47 will move leftward relative to the cutter holder 17 so that the second steel ball 46 is separated from the upper edge of the cutter shaft 40 and, in its place, the first steel ball 45 presses down against the upper edge of the cutter shaft 40. The cutter shaft 40 will move downward by a distance equal to the difference between the radius of the first steel ball 45 and the radius of the second steel ball 46, so that the full cut position can be selected.

Before the vertical position of the cutter shaft 40 can be changed by leftward and rightward movement of the horizontal support body 47, the lower end of the adjustment screw 52 must rise over the curved protrusion 51 at the upper surface of the cover body 48 with a resistive click. Therefore, the horizontal support body 47 will not accidentally shift leftward or rightward. As a result, the selected height of the cutter shaft 40 will not unintentionally fluctuate. As shown in FIG. 6, in order to regulate the maximum movement of the horizontal support body 47 in the leftward and rightward directions, the cover body 48 can be configured so that its front edge (and rear edge) abuts against the inner surface of the hollow case portion 17*b* when the horizontal support body 47 is moved to a maximum desired position in the leftward and rightward directions.

When the roll sheet 2 is not to be cut, the cutter holder 17 should be retracted to a corner of the bed 16 where the roll sheet 2 does not pass. Alternatively, the first electromagnetic solenoid 35 can be turned on so that the cutter holder 17 is entirely lifted greatly away from the bed 16.

Figure 7:
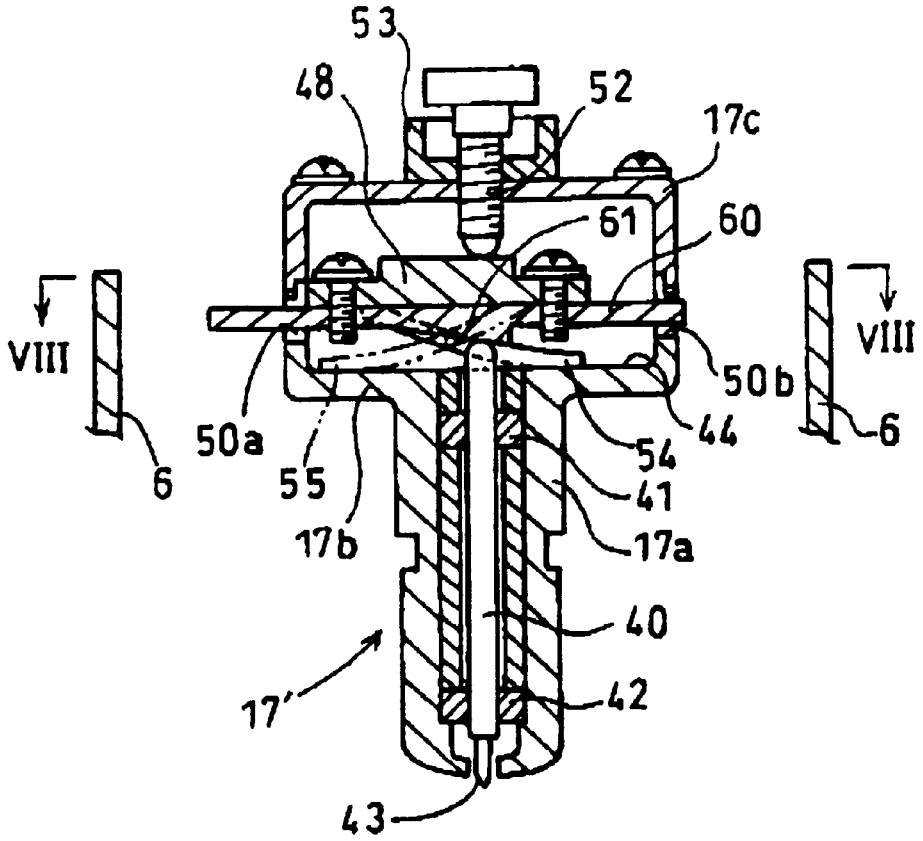
FIG. 7 is a cross-sectional side view showing a cutter holder according to a second embodiment of the present invention.
Figure 8:
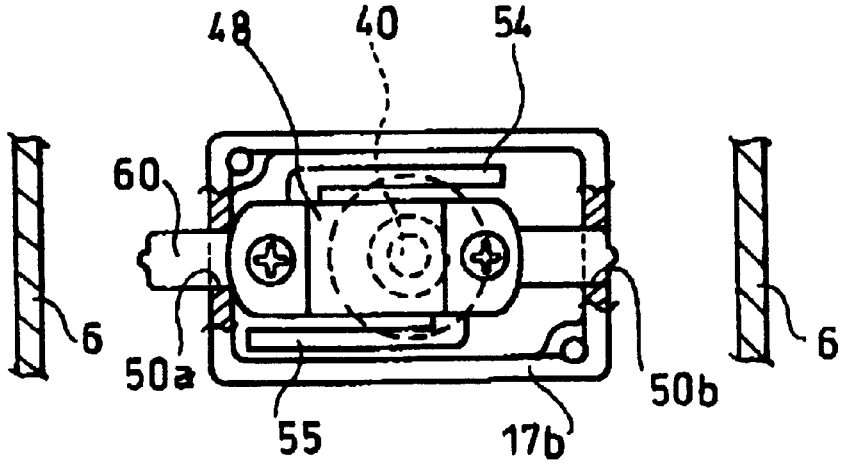
FIG. 8 is a cross-sectional view taken along line VIII—VIII of FIG. 7.

Next, a second embodiment of the present invention will be described while referring to FIGS. 7 and 8. A horizontal support body 60 is positioned so as to be movable in leftward and rightward directions within the hollow case portion 17*b* of a cutter holder 17'. A slanting surface 61 is formed on the lower surface of the horizontal support body 60. The slanting surface 61 is for a selecting vertical position of the cutter shaft 40. The hemispherical upper end of the cutter shaft 40 abuts against the slanting surface 61. The left and right ends of the horizontal support body 60 protrude out of the cutter holder 17' through the guide grooves 50*a,* 50*b* cut into the side surface of the hollow case portion 17*b*. The upper surface of the cover body 48 is level. The downward-facing hemispherical lower end of the adjustment screw 52 abuts against the upper surface of the cover body 48 in order to adjust the vertical position of the cover body 48 and the cutter shaft 40. Other configuration is substantially the same as that of the first embodiment, the same components and configuration are provided with the same numbering and their detailed description is omitted.

According to the second embodiment, by moving the horizontal support body 60 to the inner rightward edge of a cutter holder 17', the cutter shaft 40 will be maximally raised up into the half cut position. On the other hand, by moving the horizontal support body 60 to the inner leftward edge of the cutter holder 17', the cutter shaft 40 will be maximally lowered into the full cut position. By stopping the upper edge of the cutter shaft 40 at a intermediate position along the slanting portion 61, the depth of the half cut can be adjusted to increase with a distance of the horizontal support body 60 in the leftward direction. Accordingly, the vertical position of the cutter shaft 40 can be adjusted linearly rather than in a step-like manner.

Figure 9:
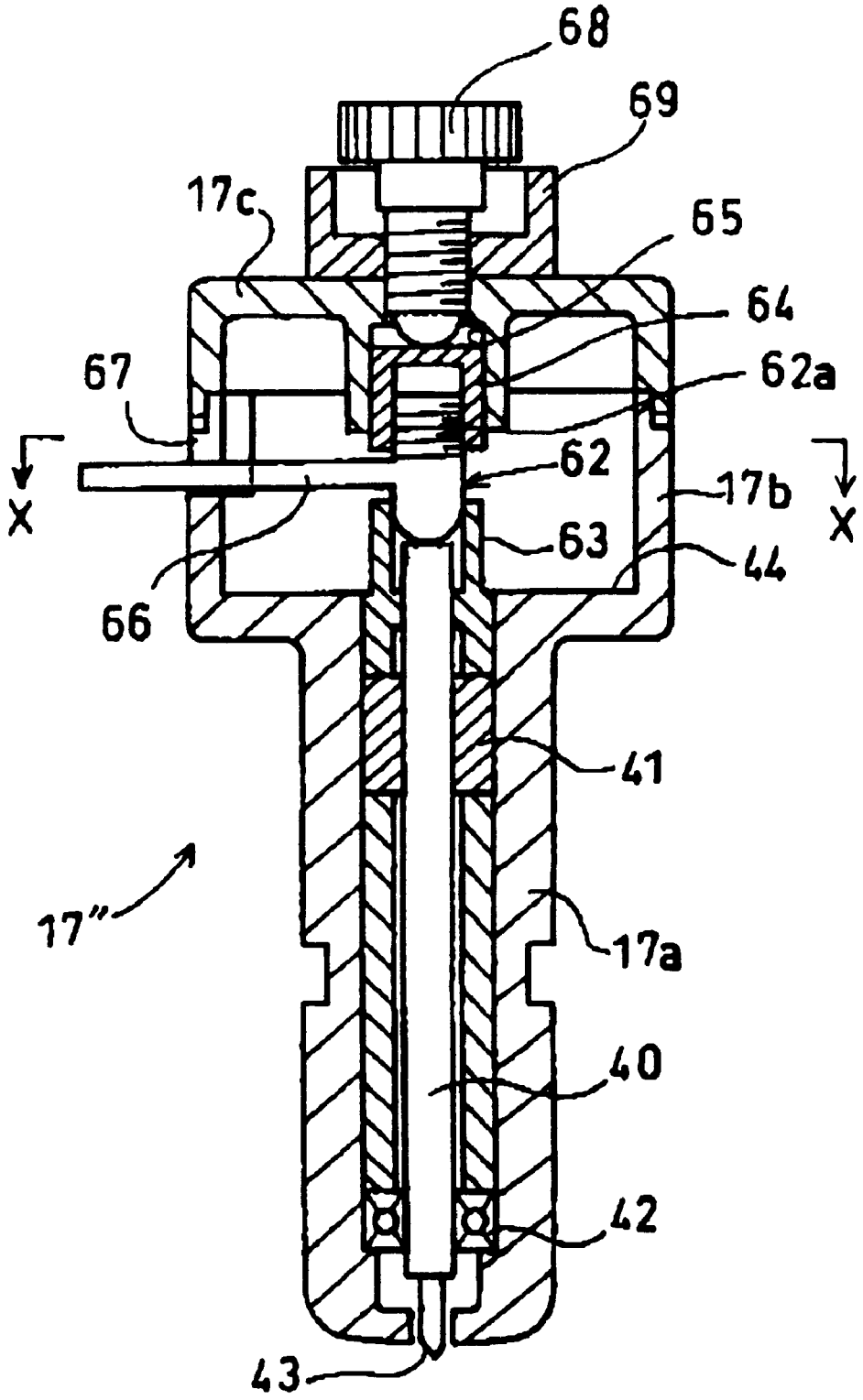
FIG. 9 is a cross-sectional view showing a cutter holder according to a third embodiment of the present invention.
Figure 10:
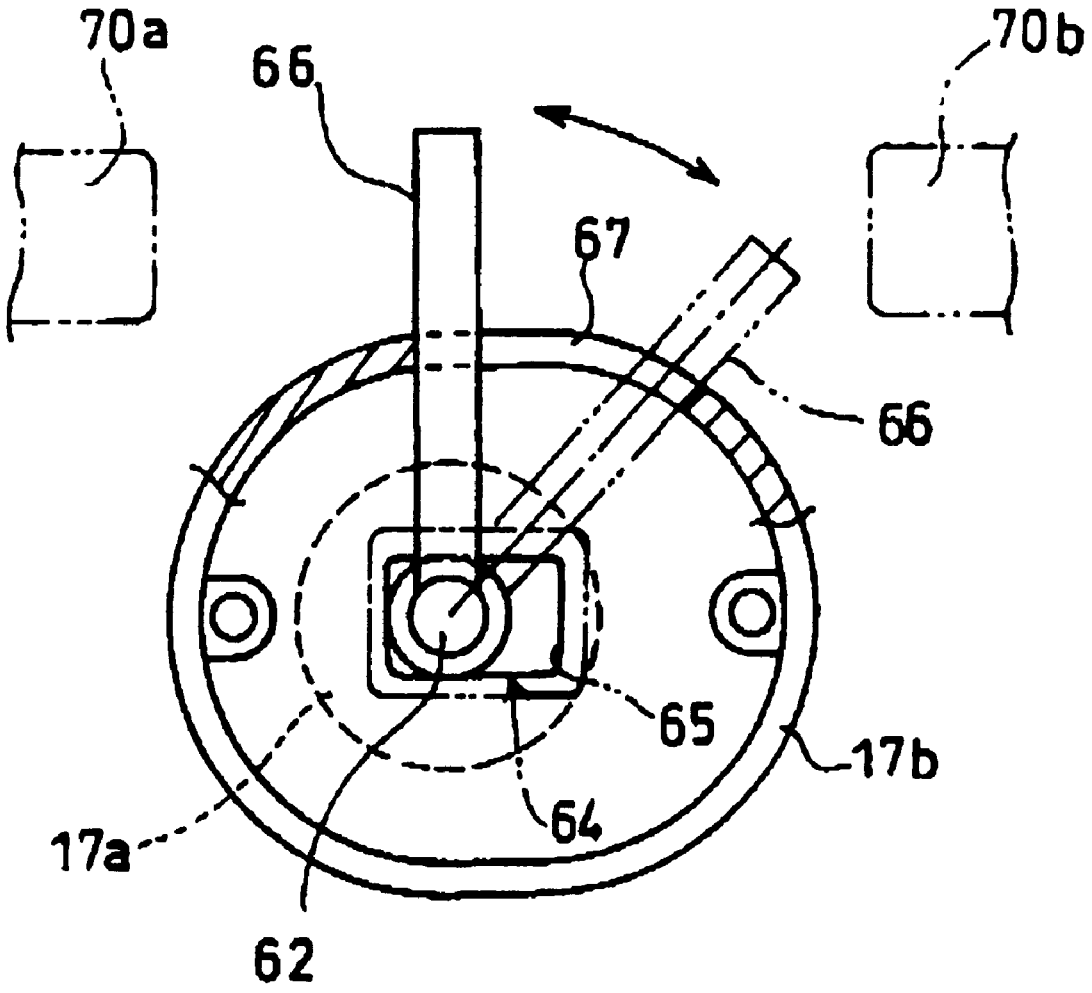
FIG. 10 is a cross-sectional view taken along line X—X of FIG. 9.

According to a third embodiment shown in FIGS. 9 and 10, a cutter shaft 40 of a cutter holder 172" is rotatably and vertically movably disposed in the guide cylinder portion 17*a*. A hollow case portion 17*b* is connected to the upper part of the guide cylinder portion 17*a*. A chamber 44 is defined by the hollow case portion 17*b* and a lid portion 17*c,* which covers the upper part of the hollow case portion 17*b*. The upper end (horizontal end surface) of the cutter shaft 40 is exposed in the chamber 44. A guide cylinder portion 63 is provided in the chamber 44. The lower peripheral surface of a selection body 62 is rotatably supported in the guide cylinder portion 63. The selection body 62 has an elongated round-rod shape and is for selecting a vertical position of the cutter shaft 40. A fitted body 64 is disposed in an indentation 65 formed in the lower surface of the lid portion 17*c*. The fitted body 64 has a substantial rectangular shape when viewed in a plan view, and so cannot be rotated, but is movable in the vertical direction. A screw portion 62*a* is formed at the outer periphery of the selection body 62. The screw portion 62*a* is a right-hand screw in the present embodiment and is screwingly engaged in the fitted body 64. An operation arm 66 protrudes from the vertical center of the selection body 62. A window 67 is formed by cutting out a side surface of the hollow case portion 17*b*. The operation arm 66 protrudes out from the cutter holder 17" through the window 67.

An adjustment screw 68 for integrally adjusting vertical positions of both the selection body 62 and the operation arm 66 is disposed to press down on the fitted body 64. A stopper ring screw 69 prevents the adjustment screw 68 from being unintentionally rotated.

With this configuration, when the second drive motor 29 is rotated in the forward direction, the cutter holder 17" is moved leftward as viewed in FIG. 10 via the timing belt 28, so that the left side of the operation arm 66 collides against a pressing rib 70*a,* which protrudes from leftward chassis frame 6 as shown in FIG. 5. As a result, the operation arm 66 pivots in the clockwise direction as viewed in FIG. 10 into the position indicated by a two-dot chain line of the operation arm 66 in FIG. 10. In association with this, the screw portion 62*a* of the selection body 62 rotates downward out from the fitted body 64. Because the selection body 62 itself moves downward, the cutter shaft 40 is pressed downward into the full out position.

On the other hand, when the cutter holder 17" is moved rightward, the right side surface of the operation arm 66 collides against a pressing rib 70*b,* which protrudes from the right chassis frame 6. As a result, the operation arm 66 rotates in the counterclockwise direction as viewed in FIG. 10 into the position indicated in solid line in FIG. 10. In association with this, the screw portion 62*a* of the selection body 62 will screw up into the fitted body 64. Because the selection body 62 itself rises upward, the cutter shaft 40 will be raised into its half cut position.

In the third embodiment also, by stopping counterclockwise rotation of the operation arm 66 somewhere intermediate within its maximum leftward and rightward movement range, the depth of a half cut can be adjusted. This can be realized by adjusting the amount that the cutter holding 17" is moved horizontally with respect to the pressing ribs 70*a,* 70*b*.

Figure 14:
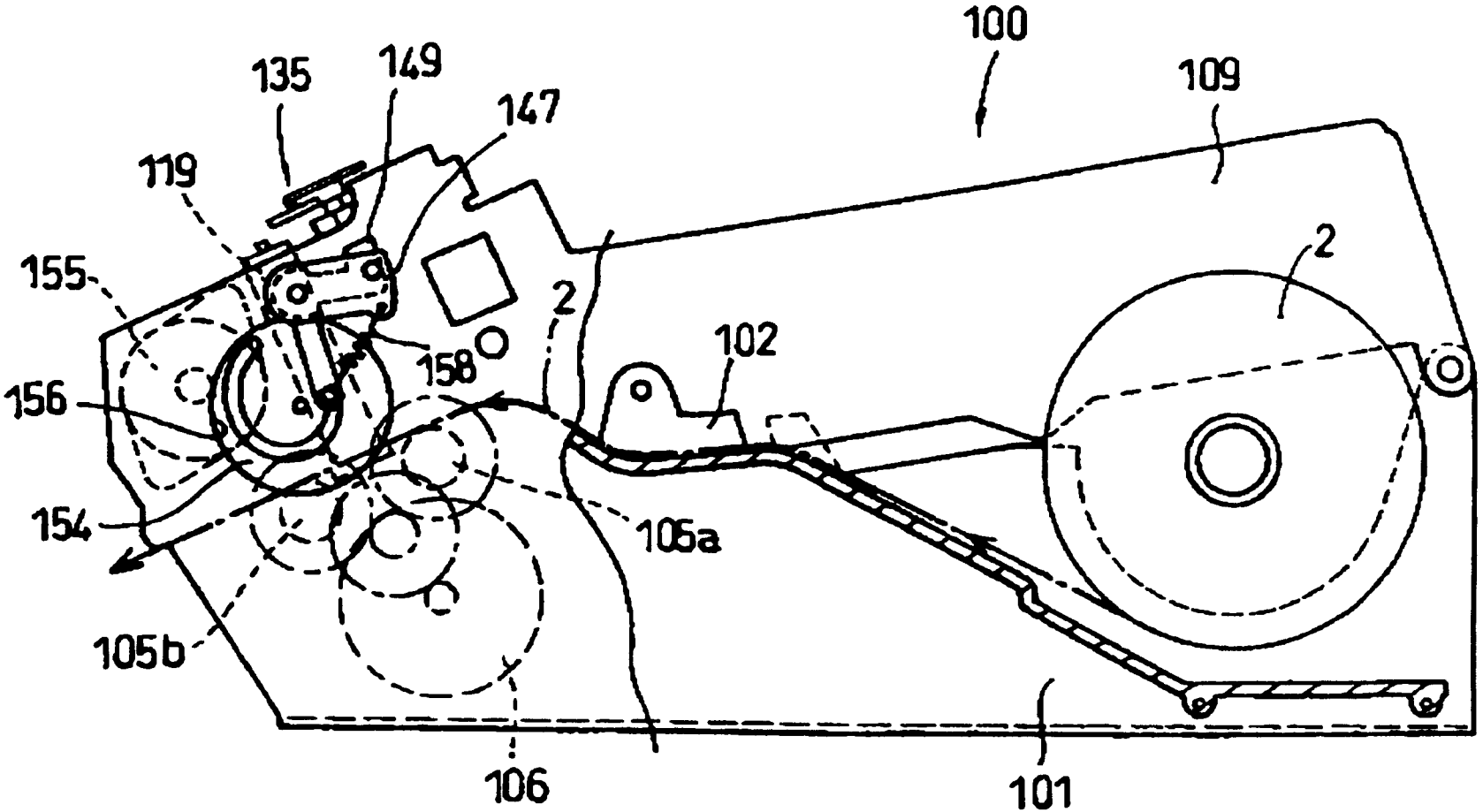
FIG. 14 is a schematic side view showing a print device according to a fourth embodiment of the present invention.
Figure 15:
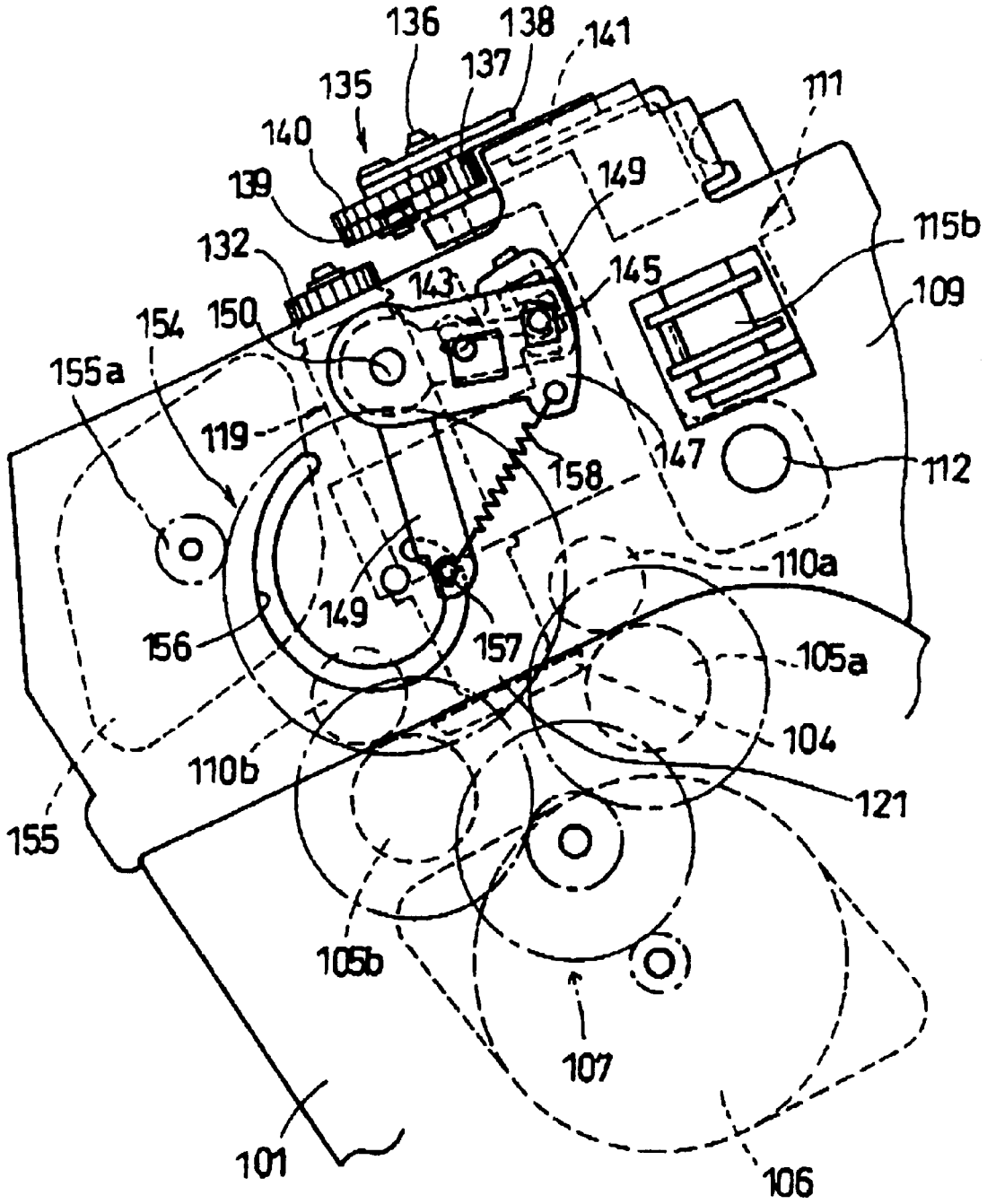
FIG. 15 is a magnified side view showing a cutting portion of the print device of FIG. 14.
Figure 16:
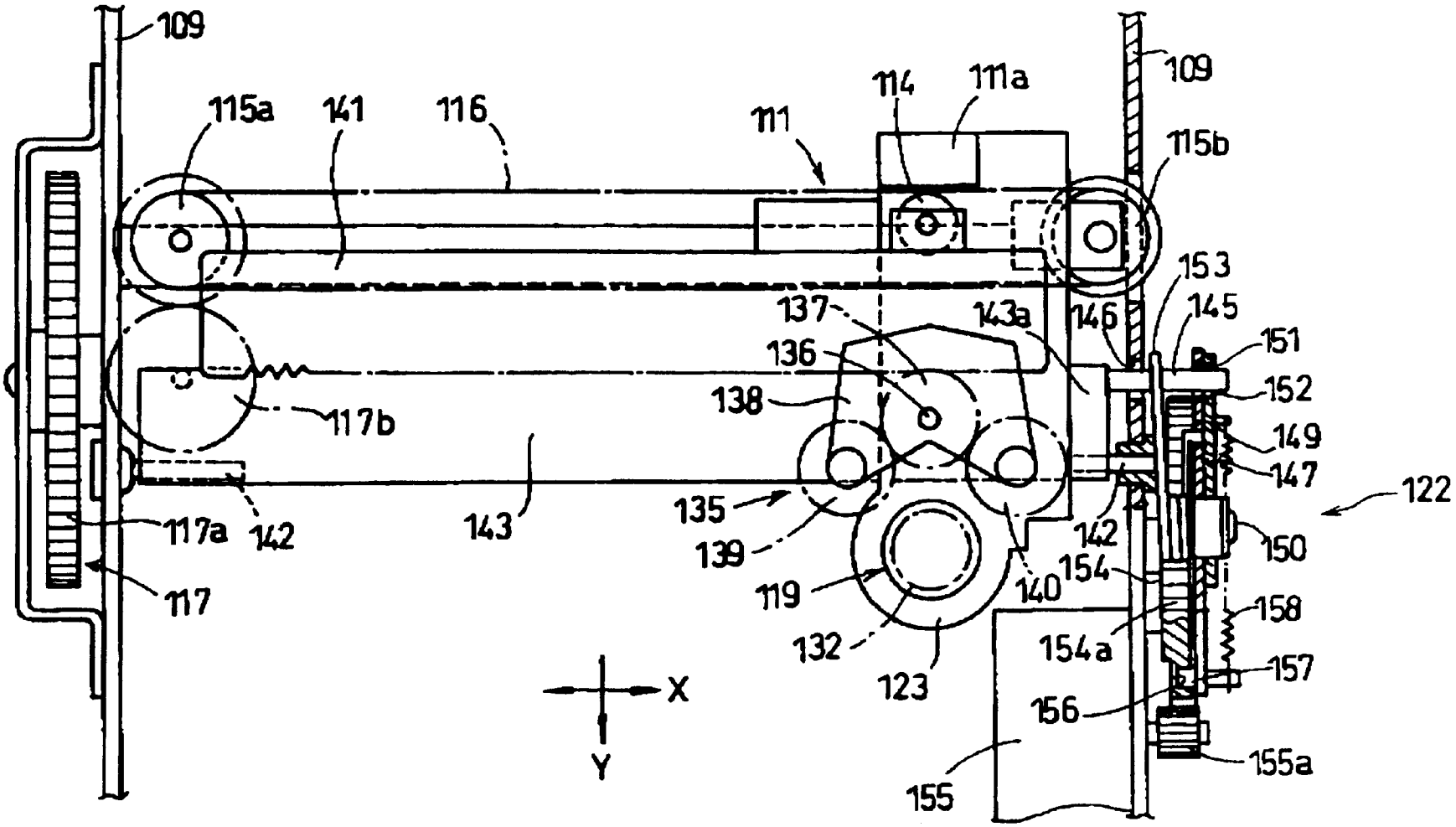
FIG. 16 is a plan view showing the cutting portion of FIG. 15.
Figure 17:
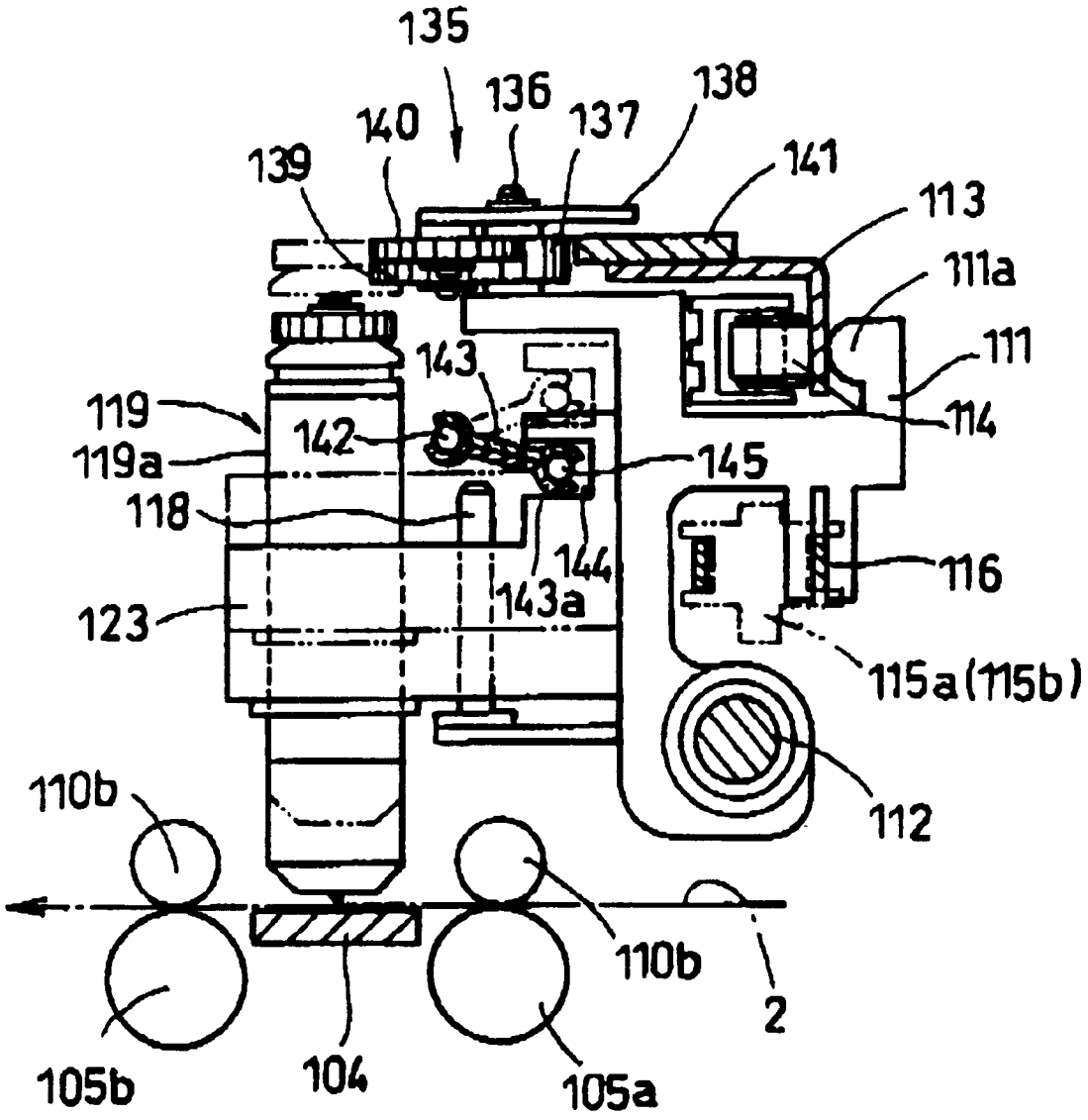
FIG. 17 is an enlarged side view showing a carriage, a cutter holder, and a selection mechanism of the print device of FIG. 14.

FIG. 14 is a schematic cross-sectional view showing a tack sheet printing device 100 according to a fourth embodiment of the present invention. FIG. 15 is a magnified view of FIG. 14 showing essential portions of a selection mechanism 135 in the tack sheet printing device 100. FIG. 16 is a plan view partially in cross-section showing mechanism for adjusting the vertical positions of the cutter holder and the cutter shaft within the cutter holder. FIG. 17 is a cross-sectional side view showing the mechanism of FIG. 16.

An explanation will be provided for the tack sheet printing device 100 according to the fourth embodiment while referring to FIGS. 14 to 17.

As shown in FIG. 14, the print device 100 has a pair of lower frames 101, 101. Upper frames 109, 109 pivot upwards with respect to a pair of roller frames 101, 101 around a mounting shaft 108. A roll sheet 2, having the same configuration as the roll sheet 2 described the first embodiment, is rotatably supported between right ends of the lower frames 101, 101. A printing portion 102 for unrolling the roll sheet 2, and printing on the recording sheet 3 of the roll sheet 2, is provided near the center of the printing device 100.

A cutter holder 119 is disposed downstream of the printing portion 102 with respect to the path traveled by the roll sheet 2. The cutter holder 119 supports a cutter 121 in confrontation with a table 104. Drive rollers 105*a,* 105*b* for transporting the roll sheet 2 between the cutter holder 119 and the table 104 are disposed upstream and downstream on either side of a table 104. The drive rollers 105*a,* 105*b* are both driven to rotate in the same direction by a Y-axis motor 106 via a gear transmission mechanism 107. Pinch rollers

110*a,* 110*b* are disposed between the upper frames 109, 109 at a position confronting the drive rollers 105*a,* 105*b* from above. When the upper frames 109, 109 are pivoted downward closed on the lower frames 101, 101, the roll sheet 2 is sandwiched between and transported by the pinch rollers 110*a,* 110*b* and the drive rollers 105*a,* 105*b.*

After the print portion 102 prints on the roll sheet 2, the roll sheet 2 is picked up by the rollers 105*a,* 105*b,* 110*a,* 110*b* and is transported leftward as viewed in FIG. 14, between the cutter holder 119 and the table 104, whereupon the cutter 121 completely or half cuts the roll sheet 2.

A carriage 111 is provided for reciprocally transporting the cutter holder 119 is a widthwise direction, that is, in an X direction, across the roll sheet 2. A main guide shaft 112 having a circular rod shape is suspended between the pair of upper frames 109, 109. The carriage 111 is freely slidably mounted on the main guide shaft 112 in the X direction.

As best seen in FIG. 17, a slide rod 111*a* having a protruding curved shape in cross section is provided to a rear surface of the carriage 111. A slide roller 114 is supported by the carriage 111 in confrontation with the slide rod 111*a*. An auxiliary guide shaft 113 having an L shape in cross section, extends between the pair of upper frames 109, 109 at a position above the carriage 111. The auxiliary guide shaft 113 is freely slidably sandwiched between the slide rod 111*a* and a slide roller 114 so as to support the posture of the carriage 111.

As shown in FIG. 16, a slave pulley 115*b* and a drive pulley 115*a* are positioned on inner surfaces of the pair of upper frames 109, 109. A timing belt 116 is wrapped between the slave pulley 115*b* and the drive pulley 115*a*. One position on the timing belt 116 is fixed to an attachment position on the rear surface of the carriage 111. A transmission gear 117*b* in meshing engagement with the drive pulley 115*a* has a bevel gear (not shown) sharing the same rotational shaft. A gear transmission mechanism 117 is disposed on the right upper frame 109, on a side of the upper frame 109 opposite from the drive pulley 115*a*. The gear transmission mechanism 117 has a large gear 117*a* and a bevel gear (not shown) sharing the same rotational shaft as the large gear 117*a*. The bevel gear of the transmission gear 117*b* is meshingly engaged with the bevel gear of the transmission gear 117*b*. Although not shown, an X-axis motor is provided for driving the drive pulley 115*a* via the large gear 117*a,* the bevel gears (not shown), and the transmission gear 117*b*.

As best seen in FIG. 17, a vertical movement block 123 is mounted on the carriage 111 by a vertical guide 118. The vertical movement block 123 is mounted in a manner that enables free vertical movement without falling off the carriage 111.

The cutter holder 119 has a substantially cylindrical main cylinder 119*a* fixed on the vertical movement block 123. The height of the cutter holder 119 can be appropriately selected and maintained by a holder height adjustment mechanism 122 indicated in FIG. 16, and to be described later.

Figure 18:
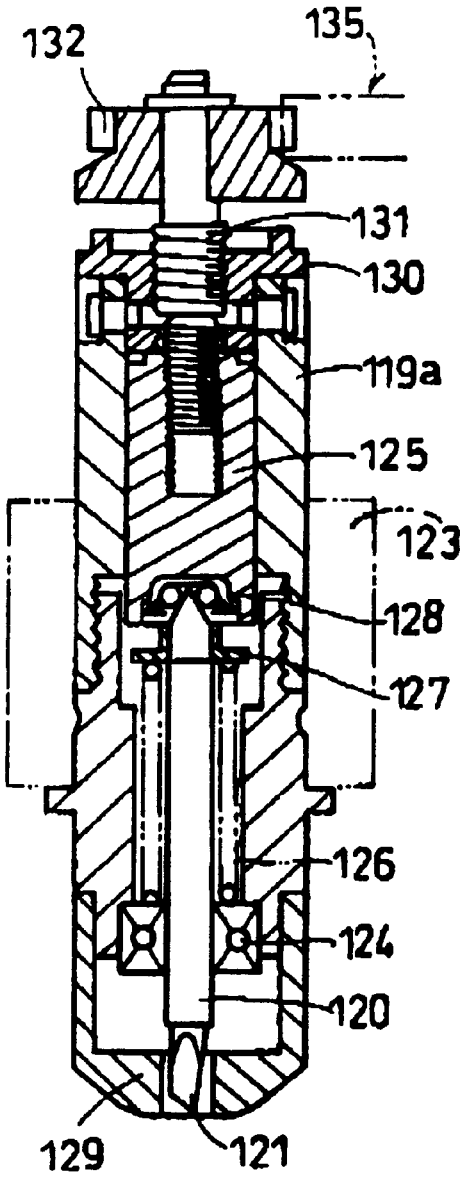
FIG. 18(*a*) is a cross-sectional view showing the cutter holder of FIG. 17 with a cutter in a retracted position.
Figure 18:
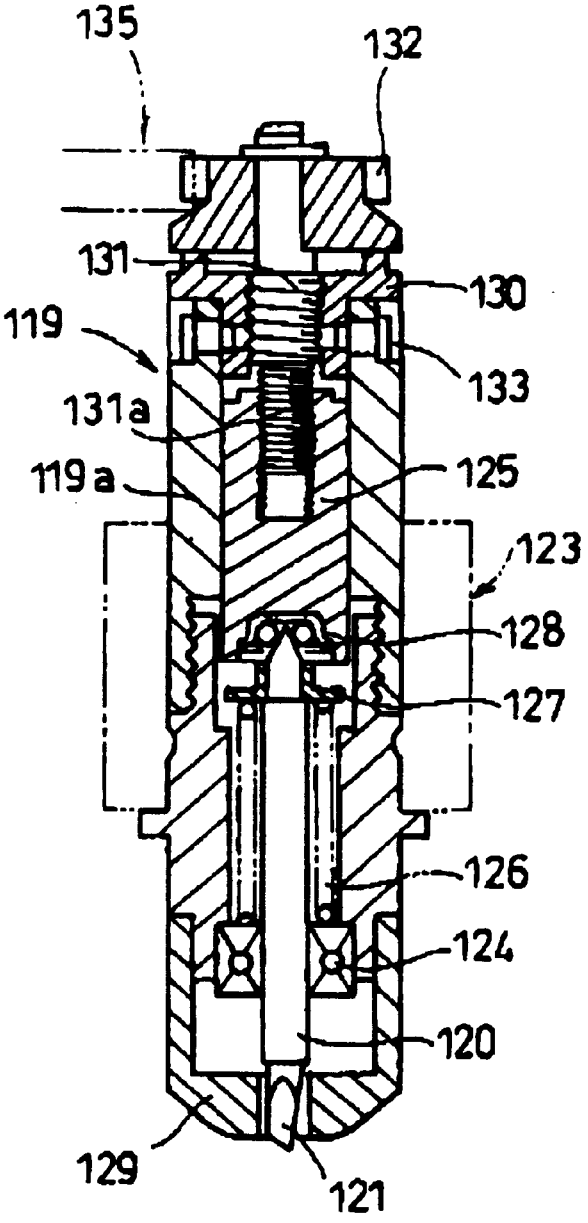

Here, an explanation will be provided for configuration of the cutter holder 119 while referring to FIGS. 18(*a*) and 18(*b*).

A circular rod-shaped cutter shaft 120 is supported in an inner diameter portion of the main cylinder 119*a* by a radial bearing 124 so as to be capable of vertical movement following an imaginary axial line of the shaft 120 and free rotational movement around the imaginary axial line. The cutter 121 is disposed at the lower end of the cutter shaft 120, in a hole formed in a slide cover 129 mounted on the lower end of the main cylinder 119*a*. In the same manner as in the first embodiment, the cutter blade of the cutter 121 is slightly eccentric with respect to the imaginary axial line (rotational center line) of the cutter shaft 120. As will be described later, configuration is provided for selectively retracting the cutter 121 into the hole of the slide cover 129 as shown in FIG. 18(*a*), and protruding the cutter 121 from the main cylinder 119*a* as shown in FIG. 18(*b*). A flange rib 127 is provided near the upper end of the cutter shaft 120. An urging spring 126 for urging the cutter shaft 120 upwards is disposed between the flange rib 127 and the bearing 124.

A presser 125 is freely vertically movably disposed in an upper portion of the inner diameter portion of the same main cylinder 119*a*. Although not shown in the drawings, the presser 125 has a angled shape, such as a square shape, in cross section to prevent it from rotating within the main cylinder 119*a*. A pivot bearing 128 is provided at the lower end of the presser 125, in abutment with a conical portion at the upper end of the cutter shaft 120, to enable the cutter shaft 120 to freely rotate with respect to the presser 125.

A screw shaft portion 131, a gear 132, and the selection mechanism 135 are provided for adjusting protrusion amount of the blade tip from the hole in the slide cover 129. A lid 130 is held by a screw 133 to the upper end of the main cylinder 119*a* so as to be freely detachable but incapable of rotation with the screw shaft portion 131. The screw shaft portion 131 is screwingly engaged in the lid 130. The screw shaft portion 131 includes a screw portion 131*a* screwed into a female screw cut into the presser 125 so that rotation of the screw shaft portion 131 vertically moves the presser 125, that is, either up or down depending on rotation direction of the screw shaft portion 131. The gear body 132*a* is connected to the tip end of the screw shaft portion 131 so as to rotate integrally with the screw shaft portion 131.

In the present embodiment, the pitch of the screw portion 131*a* is smaller than the pitch of the screw at the upper portion of the screw shaft portion 131, desirably one half as small. This configuration enables more minute adjustment in the vertical position of the presser 125. However, it should be noted that the vertical position of the presser 125 can be properly adjusted even if the pitch of the screw portion 131*a* is the same or even larger than the pitch of the screw at the upper portion of the screw shaft portion 131.

The selection mechanism 135 is for vertically moving the presser 125, that is, via the screw shaft portion 131 and the gear 132, in accordance with movement of the cutter holder 119 in the X direction, and is best shown in FIGS. 15 to 17, and FIGS. 24(*a*) to 24(*c*). The selection mechanism 135 includes a central gear 137, a pair of planetary gears 139, 140, and a rack 141. The central gear 137 is freely rotatably supported on a vertical shaft 136 protruding from an upper end of the carriage 111. A bracket 138 is swingingly pivotably mounted on the vertical shaft 136. The pair of planetary gears 139, 140 are supported on the bracket 138 in constant meshing engagement with the central gear 137. The rack 141 is fixed in place following the lengthwise direction of the auxiliary guide shaft 113 and is meshingly engaged with the central gear 137.

Figure 20:
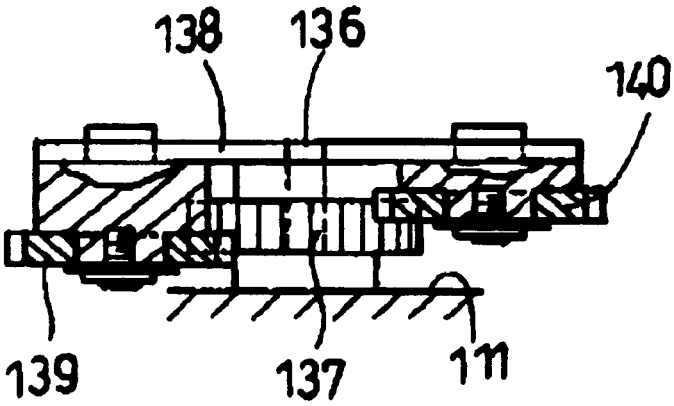
FIG. 20 is a frontal view of the selection mechanism of FIG. 17.

As shown in FIG. 20, the planetary gears 139, 140 are disposed at different heights in the axial direction of the screw shaft portion 131 so that the left side planetary gear 139 engages the gear 132 at a height lower than where the right side planetary gear 140 engages with the gear 132 by an amount substantially the same as the thickness of the gear 132.

With this configuration, the pair of planetary gears 139, 140 can selectively meshingly engaged with the gear 132 of the cutter holder 119 to selectively rotate the gear 132 forwardly or reversibly, and consequently adjust the vertical position of the presser 125 in the cutter holder 119. That is, when the carriage 111 moves rightward as viewed in FIGS. 16 and 24(*b*), the central gear 137 rotates counterclockwise and the planetary gears 139, 140 rotate clockwise, thereby pivoting the bracket 138 counterclockwise to bring the left side planetary gear 139 into meshing engagement with the gear 132. Rotation of the left side planetary gear 139 rotates the gear 132 counterclockwise, thereby raising the presser 125 up as shown in FIG. 18(*a*). In this condition, the cutter 121 is retracted into the hole at the lower end of the cutter holder 119.

Figure 24:
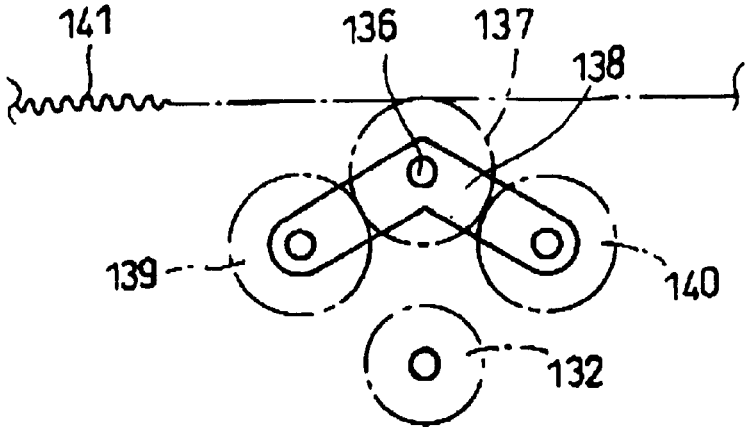
FIG. 24(*a*) is a plan view showing orientation of the selection mechanism in a release condition.
Figure 24:
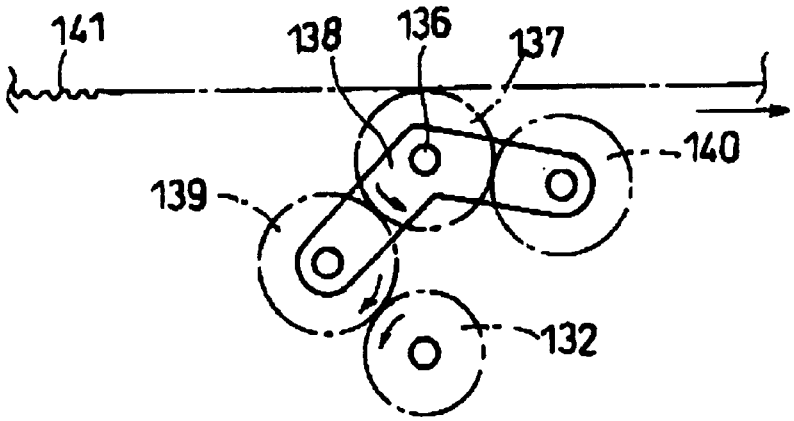
Figure 24:
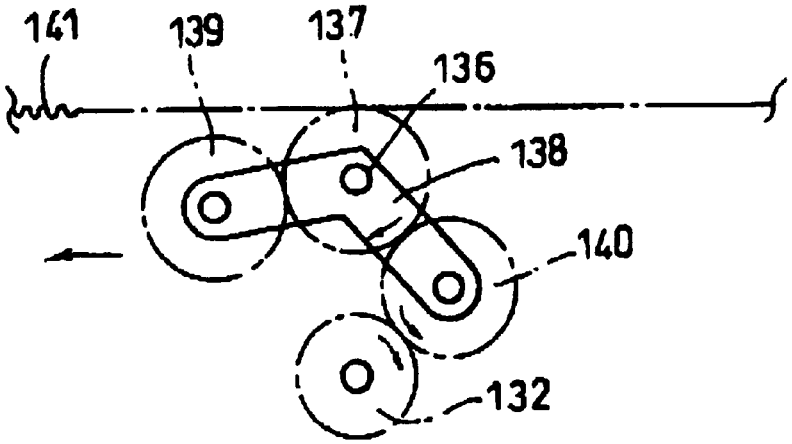
Figure 25:
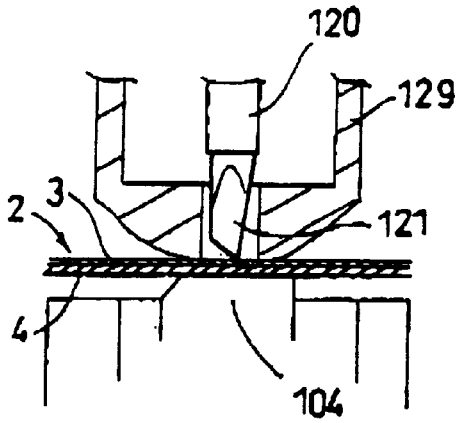
FIG. 25(*a*) is a cross-sectional view showing the cutter in a release condition retracted away from the tack sheet.
Figure 25:
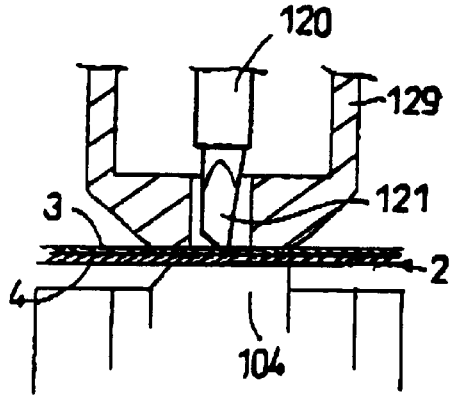
Figure 25:
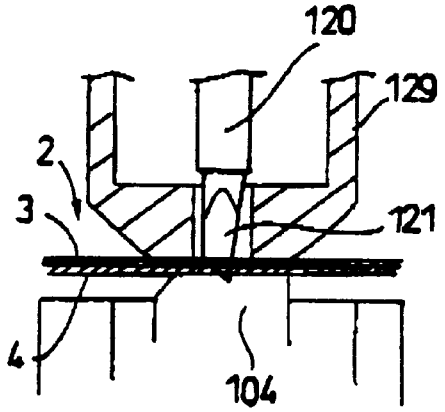

Contrarily, when the carriage 111 moves leftward as viewed in FIGS. 16 and 24(*c*), the central gear 137 rotates clockwise and the planetary gears 139, 140 rotate counterclockwise, thereby pivoting the bracket 138 clockwise, to bring the right side planetary gear 140 into meshing engagement with the gear 132. Rotation of the right side planetary gear 140 rotates the gear 132 clockwise so that the presser 125 is lowered as shown in FIG. 18(*b*). In this condition, urging force of the spring 126 urges the cutter 121 to protrude out from the hole in the lower end of the cutter holder 119.

Next, the holder height adjusting mechanism 122 indicated in FIG. 16 will be described while referring to FIGS. 15 to 17, 19, and 20 to 23. The holder height adjusting mechanism 122 enables changing and maintaining the vertical position of the cutter holder 119 to a variety of heights.

As shown in FIG. 16, a horizontal shaft 142 is supported between the pair of upper frames 109, 109. One edge of an elongated pivot member 143 is mounted on the horizontal shaft 142. The other edge of the pivot member 143 is formed with rod-shaped slide portion 143*a*. As shown in FIG. 17, the slide portion 143*a* is fitted in a fitting portion 144 formed in the vertical movement block 123 so as to be capable of pivoting and moving horizontally in the fitting portion 144. With this configuration, the pivot body is pivotable upward and downward around the horizontal shaft 142 between the position shown in straight line and the position shown in two-dot chain line in FIG. 17.

Figure 19:
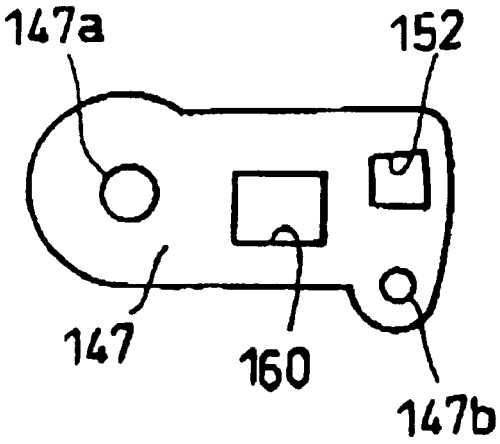
FIG. 19(*a*) is a side view showing a first lever of a mechanism for setting vertical position of the cutter holder.
Figure 19:
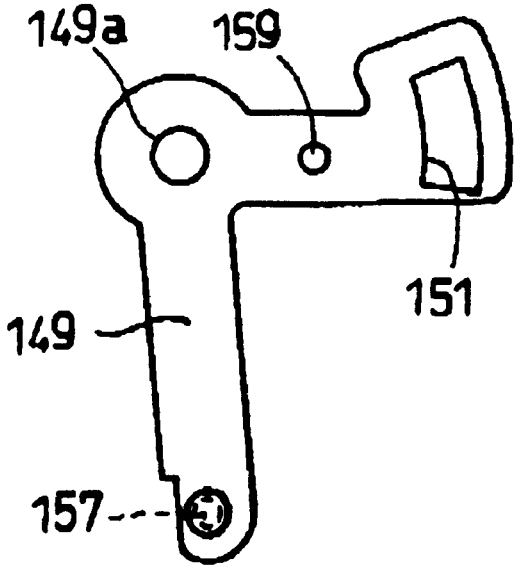

A first lever 147 and a second lever 149 are supported on the outside of the upper frame 109, with the second lever 149 closer to the side surface of the upper frame 109. As shown in FIG. 19(*a*), the first lever 147 is formed with a shaft hole 147*a* near one end, a substantially square-shaped restricting hole 152 near the other end, and a substantially rectangular-shaped second restriction hole 160 near the middle. A spring support hole 147*b* is formed near the restricting hole 152.

As shown in FIG. 19(*b*), the second lever 149 has a two-armed shape, with a shaft hole 149*a* formed at the juncture of the two arms, an engagement pin 157 protruding both leftward and rightward, as viewed in FIG. 16, from near the tip of one arm, and an elongated hole 151 formed near the tip of the other arm. A restricting pin 159 is formed between the shaft hole 149*a* and the elongated hole 151.

Figure 21:
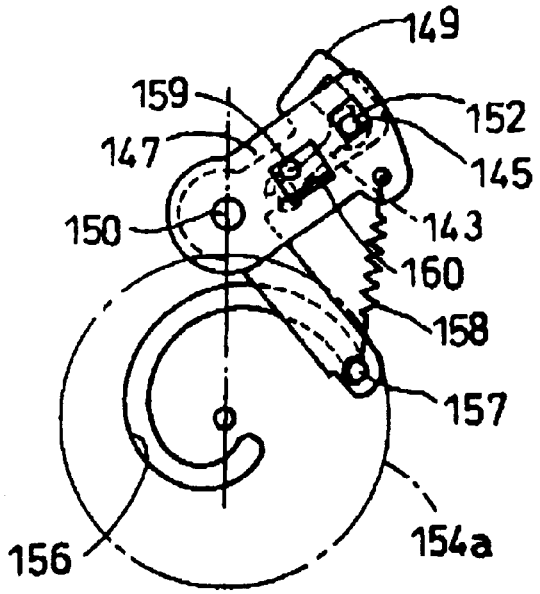
FIG. 21(*a*) is a side view showing the mechanism for setting vertical position of the cutter holder, wherein a cam plate thereof is oriented in an origin setting phase of 0°.
Figure 21:
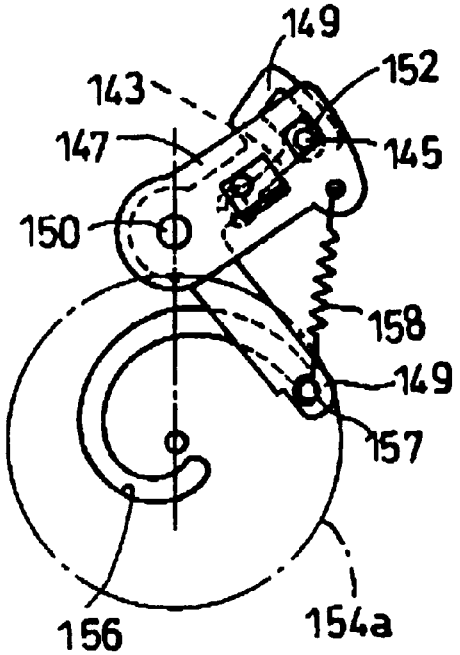
Figure 21:
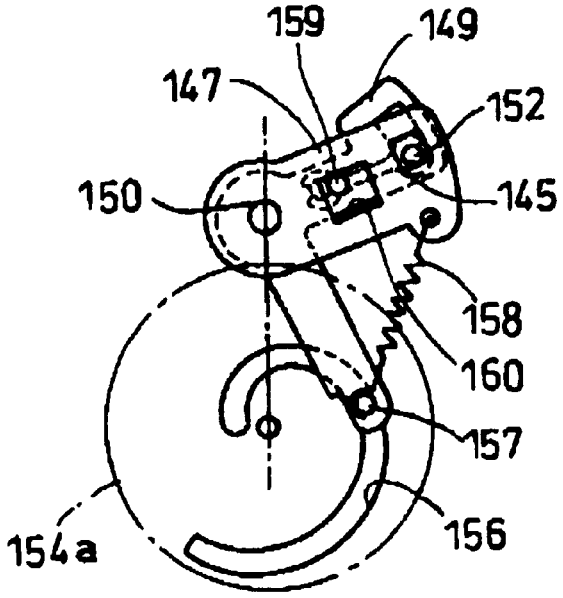

As shown in FIG. 16, the first lever 147 and the second lever 149 are freely pivotably supported on the same shaft 150 via the shaft holes 147*a*, 149*a*, respectively. An operation pin 145 protrudes horizontally from one end of the slide portion 143*a*, outward from a window hole 146 of the upper frame 109, and through the elongated hole 151 and the restricting hole 152. As shown in FIG. 21(*c*), the restricting pin 159 of the second lever 149 is exposed through the second restriction hole 160 of the first lever 147.

A Z-axis motor 155 is disposed on the inner surface of the upper frame 109, with its pinion gear 155*a* protruding through to the outside of the upper frame 109. The Z-axis motor 155 is formed from a stepping motor capable of forward and reverse rotation.

A cam plate 154 is freely rotatably supported on an outer surface of the upper frame 109. The cam plate 154 is formed at its outer peripheral surface with a gear 154*a* in meshing engagement with the pinion gear 155*a* of the Z-axis motor 155. The outer surface of the cam plate 154 is formed with a spiral-shaped cam groove 156 engaged with one end of the engagement pin 157. A tension spring 158 spans between the other end of the engagement pin 157 and the spring support hole 147*b* of the first lever 147.

Figure 23:
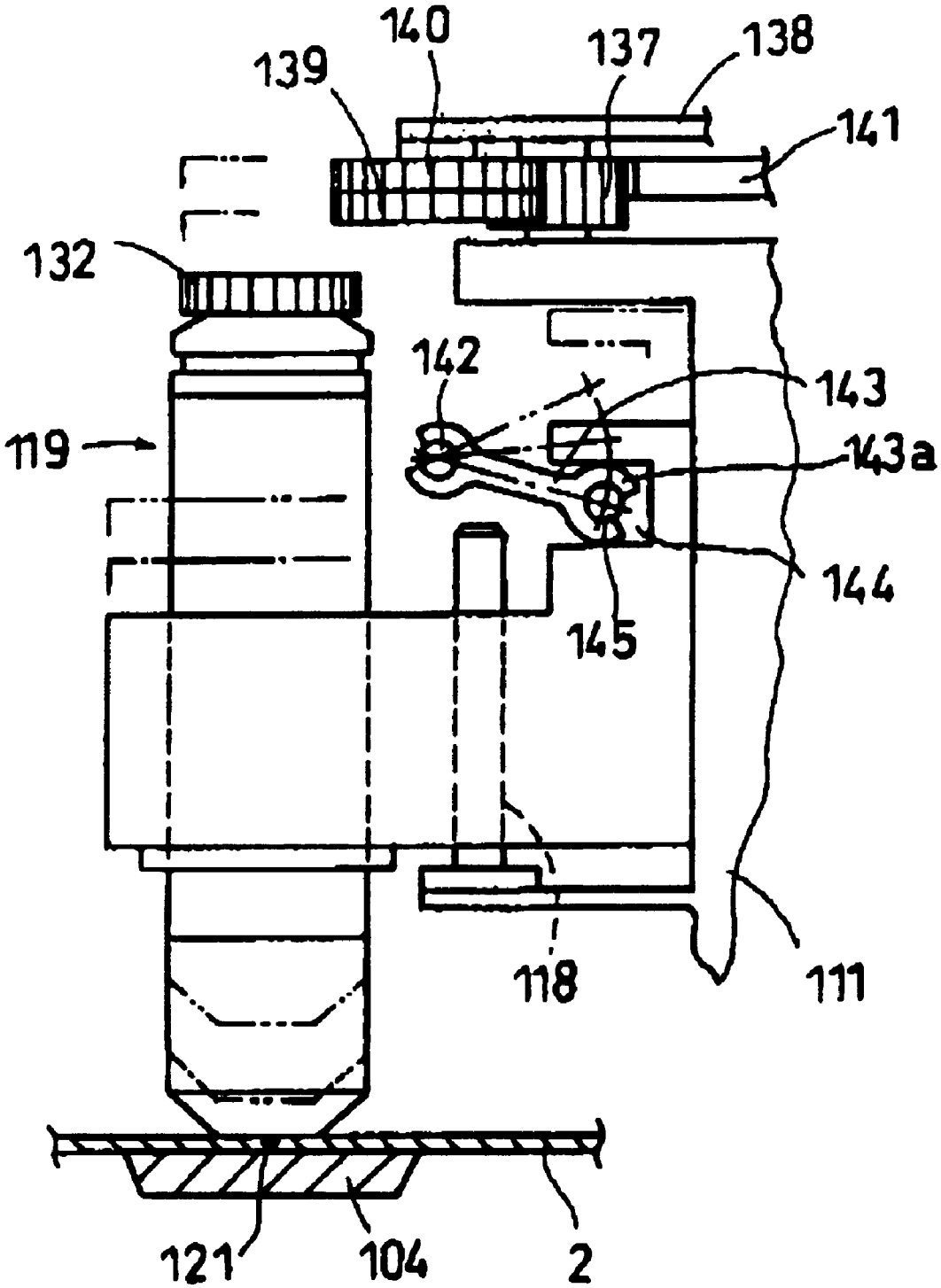
FIG. 23 is a side view showing changes in vertical position of the cutter holder of the fourth embodiment.

A coil spring 153 shown in FIG. 16 is provided between the second lever 149 and the operation pin 145 to urge the operation pin 145, and consequently the free end of the pivot member 143, downward into the orientation shown in FIG. 23. The coil spring 153 has an urging force low enough so that the blade tip of the cutter 121 does not pierce into the coil sheet 2 merely by the urging force of the coil spring 153 alone.

With this configuration, after the power of the print unit I is turned on and initiation is performed, the Z-axis motor 155 rotates clockwise as viewed in FIG. 15, so the pinion gear 155*a* rotates clockwise. As a result, the cam plate 154 rotates counterclockwise, until the engagement pin 157 of the second lever 149 collides with the outer most radial end of the cam groove 156 in the orientation shown in FIG. 21(*a*). When the engagement pin 157 collides with the end of the cam groove 156, the Z-axis motor 155 loses synchronization. The phase position of the cam plate 154 when the Z-axis motor 155 loses synchronization is set as the zero degree angle of the cam. In this condition, the operation pin 145 is pressed upward by the lower edge of the main restriction hole 151 of the second lever 159, against the urging force of the coil spring 153. The free end of the pivot member 143 pivots upward by a considerably large amount, so that the vertical movement block 123, and consequently the cutter holder 119, moves upwards to prevent the blade tip of the cutter 121 from reaching the surface of the roll sheet 2 on the table 104, even if the blade tip of the cutter 121 protrudes from the hole in the slide cover 129 in the manner shown in FIG. 18(*b*).

Next, the Z-axis motor 115 is driven to rotate counterclockwise as viewed in FIG. 15 until the cam plate 154 rotates clockwise into the orientation shown in FIG. 21(*c*), which is a cam angle of about 141 degrees. Then drive of the Z-axis motor 115 is stopped. This position will be referred to as a release position and is indicated by the single-dot chain line in FIG. 23. In the release position, the cutter holder 119 is maintained at a vertical position low enough to prevent the gear 132 from meshingly engaging with the left and right planetary gears 139, 140, but high enough to still prevent the blade tip of the cutter 121 from contacting the upper surface of the roll sheet 2 on the table 104 even if the blade tip protrudes from the lower surface of the slide cover 129.

Next, the Z-axis motor 155 is started up to move the carriage 111 horizontally to a desired position in the widthwise direction of the roll sheet 2 and then temporarily stopped. In this condition, the Z-axis motor 155 is rotated clockwise as viewed in FIG. 15 until the cam plate 154 rotates counterclockwise into a cam phase angle of about nine degrees as shown in FIG. 21(*b*), whereupon the Z-axis motor 155 is stopped. In this orientation, the operation pin 145 is pressed upward by the lower edge of the main restriction hole 151 in the second lever 149 so that the free end of the pivot member 143 is pivoted upwards. As a result, the vertical movement block 123, and consequently the cutter holder 119, rises greatly upward into the vertical position indicated by a two-dot chain line condition of FIG. 23. This vertical position will be referred to as the blade tip protrusion amount adjustment position. In the blade tip protrusion amount adjustment position, the cutter holder 119 is high enough so that the blade tip of the cutter 121 does not contact the surface of the roll sheet 2 on the table 104 even if the blade tip protrude from the lower surface of the slide cover 129. Moreover, the gear 132 can meshingly engage with the left and right planetary gears 139, 140 of the selection mechanism 135 so that the protruding amount of the blade tip of the cutter 12 can be adjusted in the following manner.

That is, as mentioned previously, when the carriage 111 is moved rightward as viewed in FIG. 24(*b*), the central gear 137 rotates counterclockwise so that the bracket 138 pivots counterclockwise by forward rotation of the pair of meshingly engaged planetary gears 139, 140, and the left side planetary gear 139 meshingly engages with the gear body 132 protruding from the upper end of the cutter holder 119. Further movement of the carriage 111 is transmitted to the gear body 132, which rotates counterclockwise accordingly. The presser 125 is raised upward by the counterclockwise movement of the gear body 132. The cutter 121 is raised upward by the force of the urging spring 126 so that the blade tip is retracted into the lower end of the cutter holder 119.

Therefore, if the blade tip of the cutter 121 protrudes from the slide cover 129, that is, by an amount for either a full cut or a half cut, because of a previous cutting operation, then the blade tip of the cutter 121 can be raised up by an amount proportional to the rotation amount of the Z-axis motor 155 and the movement amount of the carriage 121, into a position completely within the hole in the lower surface of the slide cover 121. The cutter holder 119 can be transported in this condition without cutting the roll sheet 2 at all.

Contrarily, when the carriage 111 is moved leftward as viewed in FIG. 24(*c*), the left planetary gear 140 meshingly engages with the gear 132. As a result, the gear 132 is rotated clockwise and the vertical position presser 125, and consequently the cutter 12, is lowered by an amount proportional to the horizontal movement amount of the carriage 111. Therefore, the amount that the blade tip of the cutter 12 protrudes from the lower surface of the slide cover 129 can be freely adjusted, for example, from a full cut amount, wherein the blade protrudes out greatly, to a half cut amount.

Figure 22:
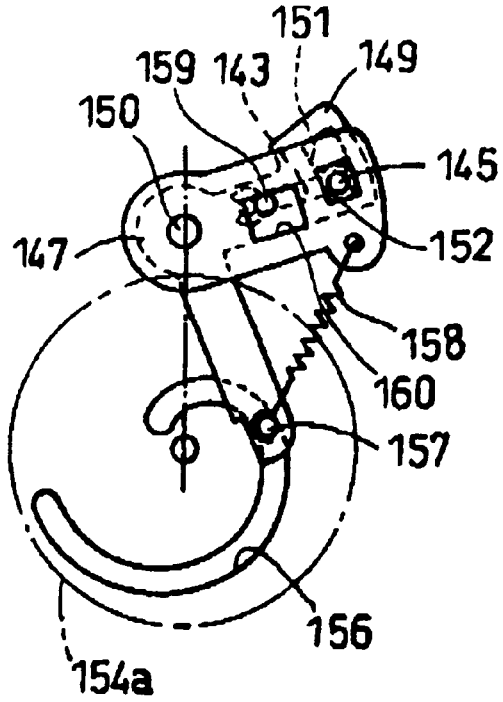
FIG. 22(*a*) is a side view showing the mechanism of FIG. 21(*a*), with the cam plate oriented in a phase of 178° for adjusting direction of the blade tip.
Figure 22:
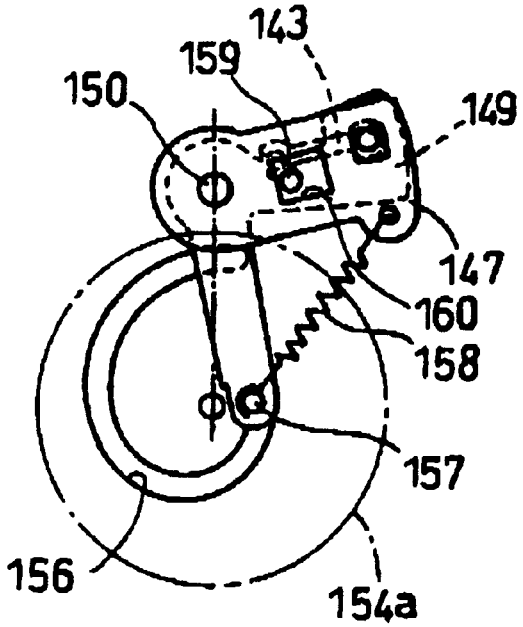

After operations for adjusting a protrusion amount of the blade tip are completed, by again lowering the cutter holder 119 to the release position indicated by the single-dot chain line in FIG. 23, the gear 132 can be maintained at a vertical position low enough so it does not meshingly engage with the left or the right planetary gears 139, 140. In this condition, the Y-axis motor 106 and the Z-axis motor 155 are started up to move the roll sheet 2 and the cutter 121 to a desired cut start position for a full cut or a half cut of the roll sheet 2. In this condition, the Z-axis motor 155 is driven so set the positional phase of the cam groove to approximately 178 degrees as shown in FIG. 22(*a*). As a result, the cutter holder 119 is slightly lowered so that the blade tip of the cutter 121 lightly abuts against the surface of the roll sheet 2.

Until the cam groove 156 reaches the cam phase angle of 178 degrees, the regulation pin 159 of the second lever 149 abuts against the upper edge of the second regulation hole 160 in the first lever 147, so that the upper edge of the main regulation hole 152 in the first lever 147 and the operation pin 145 of the rotated body 143 are separated from each other, and spring force from the coil spring 158 is not transmitted to the pivot member 143.

When further rotation of the cam plate 154 rotates the second lever 149 counterclockwise from the orientation shown in FIG. 22(*a*), urging force of the coil spring 153 between the operation pin 145 and the second lever 149, maintains the operation pin 145 in contact with the lower edge of the elongated hole 151 of the second lever 149 so that the operation pin 145, and consequently the pivot member 143, pivots counterclockwise. The vertical movement block 123 moves downward as a result.

The blade tip of the cutter 121 is abutted against the roll sheet 2 when the vertical movement block 123 moves downward. However, because the coil spring 153 is set with an urging force that is insufficient to pierce the roll sheet 2 with the blade tip of the cutter 121 using urging force of the coil spring 153 alone, the vertical movement block 123 stops lowering at the point where the blade tip of the cutter 121 abuts against the roll sheet 2. Downward movement of the operation pin 145 and pivotal movement of the pivot member 143 also stops.

As a result, further rotation of the cam plate 154 from the cam phase angle of 178 degrees rotates only the second lever 149, so that the operation pin 145 separates from the lower edge of the elongated hole 151 in the second lever 149 and a gap opens between the operation pin 145 and the main regulation hole 152. At this time, the operation pin 145 is urged downward by the weak force of the screw spring 153, so that the entire cutter holder 119 attached to the vertical movement block 123 is pressed downward by the pivot member 143 which is connected to the operation pin 145, and the blade tip of the cutter 121 at the lower end of the cutter holder 119 lightly contacts the roll sheet 2. This phase position will be referred to as a blade tip direction adjustment position. In this condition, the blade tip of the cutter 121 abutting against the surface of the roll sheet 2 can be faced in a predetermined cut direction by driving either or both of the Z-axis motor 155 and the Y-axis motor 106.

Before an actual full or half cut operation is executed, the Z-axis motor 155 is operated until the cam groove is oriented to a cam phase angle of approximately 300 degrees as shown in FIG. 22(*b*). In this phase position, the upper edges of both the main restriction hole 152 in the first lever 147 and the regulation hole 152 press the operation pin 145 downward, so that the great force of the tension spring 158 attached to the first lever 147 operates on the operation pin 145 and the free end of the pivot member 143 is greatly pivoted downward. The pivot member 143 presses the vertical movement block 123 and consequently the entire cutter holder 119 downward into the position indicated in solid line shown in FIG. 23. As a result, the blade tip of the lower end of the cutter 121 pierces the roll sheet 2 by an amount corresponding to the protrusion amount of the blade tip from the sliding plate 129.

In this condition, either or both of the Z-axis motor 155 and the Y-axis motor 106 are operated to cut the roll sheet 2, such as in an ellipsoidal, rectangular, or other optional half cut shape.

As a modification of the fourth embodiment, the presser 125 can be provided rotatable with respect to the cutter holder 119, and the screw shaft portion 131 and the presser 125 can be fixed together, such as by a vertical pin. With this configuration, rotation of the rotating body 132 rotates and raises the presser 125.

Figure 26:
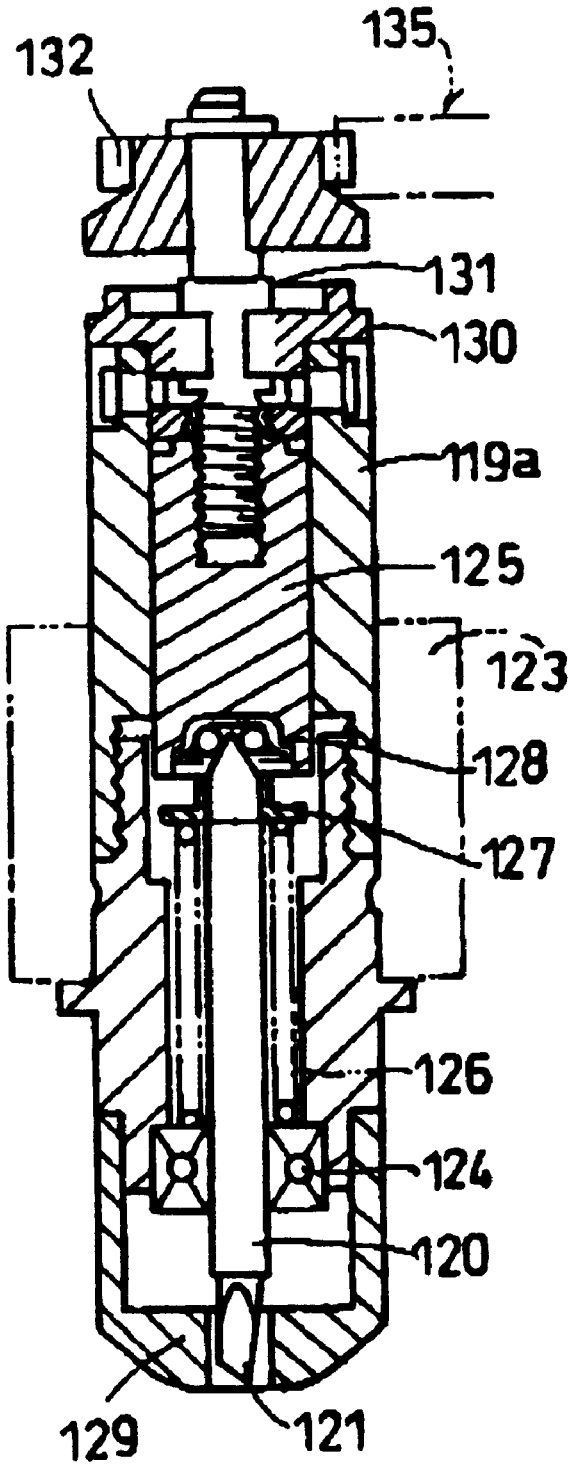
FIG. 26 is a cross-sectional view showing a cutter holder according to a modification of the fourth embodiment.

A modification of the fourth embodiment is shown in FIG. 26. The screw shaft portion 131 attached to the gear 132 is mounted so as to be freely rotatable with respect to the lid 130, rather than screwed into the lid 130. Further the presser 125 is non-rotatably fitted in the cutter holder 119 and screwingly engaged with the screw shaft portion 131. Therefore, rotation of the gear body 132 in a forward direction in accordance with movement of the carriage 111, the presser 125 will move upward in proportion to the rotation amount. Contrarily, by rotating the gear 132 reversibly, the presser 125 will be lowered in proportion to the rotation amount.

The present invention is not limited to application to a printing device for cutting a roll sheet 2. The present invention can be applied to a cutting device for completely cutting a thick paper to form a desired geometric shape, and then half cutting the resultant shape at appropriate positions so that the full cut shape can be easily bent and folded into a package box, for example.

Also, the cutter holder need not be moved by using a carriage. Instead, the bed on which the workpiece sheet is mounted can be moved along a horizontal plane in X and Y directions.

What is claimed is:

1. A cutter comprising:

a bed for supporting a work piece to be cut;

a cutter holder disposed in confrontation with the bed;

a drive mechanism that moves the cutter holder in opposing directions along a first path parallel with a surface of the bed;

a cutter shaft supported within the cutter holder movable in opposing directions along a second path that extends perpendicular to the first path, the cutter shaft having two ends, one end being provided with a cutter that selectively protrudes from one end of the cutter holder depending on position of the cutter shaft along the second path with respect to the cutter holder; and a conversion unit disposed at the other end of the cutter shaft, and that converts movement of the cutter holder driven by the drive mechanism along the first path into movement of the cutter shaft along the second path, to select the position of the cutter shaft on the second path with respect to the cutter holder and the surface of the bed.

2. A cutter as claimed in claim 1, wherein the conversion unit includes:

an operation member partially disposed in the cutter holder, and having two ends that protrude away from each other from opposite sides of the cutter holder in the opposing directions of the first path, the operation member moving in a selected one of the opposing directions of the first path by abutment of one of the ends caused by movement of the cutter holder in the other of the opposing directions of the first path; and a selection unit disposed in contact with the other end of the cutter shaft, and driven to select position of the cutter shaft along the second path by movement of the operation member in the selected one of the opposing directions of the first path.

3. A cutter as claimed in claim 2, further comprising an adjustment unit that adjusts an initial position of at least one of the selection unit and the operation member along the second path.

4. A cutter as claimed in claim 1, wherein the conversion unit includes:

a selection member with a screw portion, the selection member moving in one of the opposing directions of the second path by screwing action generated when the selection member rotates in one direction, and in another of the opposing directions of the second path by screwing action generated when the selection member rotates in an opposite direction; and an operation member having one end connected to the selection member and another end protruding through a side of the cutter holder, the operation member rotating the selection member in a corresponding direction when pivoted, the operation member pivoting according to abutment of the other end caused by movement of the cutter holder.

5. A cutter as claimed in claim 4, further comprising an adjustment unit that adjusts an initial position of the selection member along the second path.

6. A cutter as claimed in claim 1, wherein the conversion unit includes:

a presser disposed at the other end of the cutter shaft and freely moving in the opposing directions of the second path;

a movement unit connected to the presser and protruding from the other end of the cutter holder, the movement unit moving the presser selectively in the opposing directions of the second path depending on rotational direction of the movement unit; and a selection unit that rotates the movement unit in a rotational direction that depends on direction of movement of the cutter holder, in order to move the presser, and consequently the cutter shaft, in a corresponding one of the opposing directions of the second path.

7. A cutter as claimed in claim 6, further comprising a mechanism that selectively moves the cutter holder between a position adjacent to a workpiece support surface and separated from the workpiece support surface, wherein the selection unit rotates the movement unit only while the cutter holder is in the position separated from the workpiece support surface.

8. A cutter as claimed in claim 6, wherein:

the movement unit includes:

a lid disposed at the other end of the cutter holder;

a screw shaft portion screwingly engaged in the lid and interlockingly connected with the presser to move integrally with the presser along the second path; and a gear protruding from the other end of the cutter holder and rotating integrally with the screw shaft portion; and the selection unit includes a pair of planetary gears alternately engaging with the gear of the movement unit depending on movement direction of the cutter holder, one planetary gear rotating the gear of the movement unit in one direction, another of the planetary gears rotating the gear of the movement unit in another direction.

9. A cutter as claimed in claim 8, wherein the pair of planetary gears are disposed at different positions from each other in the opposing directions of the second path, and rotate the gear of the movement unit in a suitable direction to adjust position of the presser in the cutter holder with respect to the opposing directions of the second path.

10. A cutter as claimed in claim 6, wherein:

the presser is non-rotatably disposed in the cutter holder;

the movement unit includes:

a lid disposed at the other end of the cutter holder;

a shaft portion freely rotatably supported in the lid in a manner that prevents movement of the shaft portion in the opposing directions of the second path with respect to the lid, the shaft portion being screwingly engaged with the presser; and a gear rotating integrally with the shaft portion: and the selection unit includes a pair of planetary gears alternately engaging with the gear of the movement unit depending on movement direction of the cutter holder, one planetary gear rotating the gear of the movement unit in one direction, another of the planetary gears rotating the gear of the movement unit in another direction.

11. A cutter as claimed in claim 1, wherein the movement of the cutter holder along the first path is perpendicular to movement of the cutter shaft along the second path.

12. A device for adjusting vertical position of a cutter, comprising:

a bed for supporting a work piece to be cut;

a cutter holder disposed in confrontation with the bed;

a drive mechanism that moves the cutter holder in a horizontal direction in parallel with a surface of the bed;

a cutter shaft freely movable in a vertical direction within the cutter holder, a cutter being provided at a lower end of the cutter shaft;

a selection unit abutting a top end of the cutter shaft and selecting rising amount of the cutter shaft in the vertical direction within the cutter holder; and an operation member that moves the selection member to select rising amount of the cutter shaft in the vertical direction in accordance with movement of the cutter holder driven by the drive mechanism in the horizontal direction.

13. A cutter as claimed in claim 12, wherein:

the operation member is capable of reciprocal linear movement in directions intersecting an axial line of the cutter shaft;

front and rear ends of the operation member protrude from opposite side surfaces of the cutter holder in directions corresponding to linear movement directions of the operation member; and the operation member moves the selection member when the cutter holder is moved in parallel with linear movement directions of the operation member.

14. A device as claimed in claim 12, wherein the selection member spirally moves with respect to the cutter holder, in parallel with an axial line of the cutter shaft; and the operation member is connected to the selection unit, a front tip of the operation member protruding from a side surface of the cutter holder, the operation member pivoting around the axial line of the cutter shaft with movement of the cutter holder in the horizontal direction, thereby spirally moving the selection member.

15. A device as claimed in claim 12, further comprising an adjustment unit that adjusts an initial vertical position of at least one of the selection member and the operation member.

16. A device for adjusting vertical position of a cutter, comprising:

a cutter holder movable vertically and horizontally with respect to a table surface, the cutter holder having two ends;

a vertically moving presser fitted in the cutter holder so as to be freely vertically movable in at least an axial direction of the cutter holder;

a cutter shaft supported in the cutter holder so as to be freely rotatable and vertically movable, the cutter shaft having two ends, one end provided with a blade that protrudes from and retracts into one end of the cutter holder with vertical movement of the cutter shaft, the other end rotating freely with respect to the vertically moving presser;

a movement unit interlockingly linked with the vertically moving presser and protruding from the other end of the cutter holder, the movement unit raising and lowering the vertically moving presser by forward and reverse rotation, respectively: and a selection operation member for rotating the movement unit selectively forward and in reverse in accordance with horizontal movement of the cutter holder while the cutter holder is in a position raised vertically away from the table surface.

17. A device as claimed in claim 16, wherein:

the movement unit includes:

a lid disposed at another end of the cutter holder opposite the end;

a screw shaft portion screwingly engaged in the lid and interlockingly connected with the vertically moving presser to vertically move integrally with the vertically moving presser; and a gear rotating integrally with the screw shaft portion; and the selection operation member includes a pair of planetary gears that freely swing in accordance with horizontal movement of the cutter holder, alternately into meshing engagement with the gear of the movement unit depending on direction of horizontal movement of the cutter holder.

18. A device as claimed in claim 17, wherein the pair of planetary gears are disposed at different heights in an axial direction of the screw shaft portion, and adjust vertical position of the vertically moving presser in the cutter holder by selectively forwardly and reversibly rotating the gear of the movement unit.

19. A device as claimed in claim 16, wherein:

the vertically moving presser is prevented from rotating;

the movement unit includes:

a lid disposed at the other end of the cutter holder;

a shaft portion rotatably supported on the lid and screwingly engaged with the vertically moving presser; and a gear rotating integrally with the shaft portion; and the selection operation member includes a pair of planetary gears that freely swing in accordance with horizontal movement of the cutter holder, alternately into meshing engagement with the gear of the movement unit depending on direction of horizontal movement of the cutter holder.

* * * * *